US006170942B1

(12) United States Patent
Ogawa et al.

(10) Patent No.: US 6,170,942 B1
(45) Date of Patent: Jan. 9, 2001

(54) INK SUPPLY DEVICE

(75) Inventors: Hiroo Ogawa; Makoto Ishii, both of Nagoya (JP)

(73) Assignee: Brother Kogyo Kabushiki Kaisha, Aichi-Ken (JP)

( * ) Notice: Under 35 U.S.C. 154(b), the term of this patent shall be extended for 0 days.

(21) Appl. No.: 09/110,317

(22) Filed: Jul. 6, 1998

(30) Foreign Application Priority Data

Jul. 4, 1997 (JP) ..... 9-179689
Jul. 7, 1997 (JP) ..... 9-180974

(51) Int. Cl.[7] ..... B41J 2/175
(52) U.S. Cl. ..... 347/88
(58) Field of Search ..... 347/87, 88, 89, 347/37

(56) References Cited

U.S. PATENT DOCUMENTS

| | | | | |
|---|---|---|---|---|
| 4,823,146 | | 4/1989 | Cooke et al. | 347/88 |
| 5,223,860 | * | 6/1993 | Loofbourow et al. | 347/88 |
| 5,975,690 | * | 11/1999 | Grellmann et al. | 347/88 |
| 6,015,202 | * | 1/2000 | Hiramatsu et al. | 347/32 |

FOREIGN PATENT DOCUMENTS

| | | | | |
|---|---|---|---|---|
| 2-113951A | * | 4/1990 | (JP) | 347/88 |
| 10-34959 | | 2/1998 | (JP) . | |

* cited by examiner

*Primary Examiner*—N. Le
*Assistant Examiner*—Shih-wen Hsieh
(74) *Attorney, Agent, or Firm*—Oliff & Berridge PLC

(57) ABSTRACT

The discharging sections for the respective colors are arranged on the ink case at an interval P in the main scanning direction. On the carriage, the melting hoppers for the respective colors are arranged at an interval T in the main scanning direction. The carriage is also provided with the hook abutting protrusions for the respective colors. The hook abutting protrusions are arranged at an interval R in the main scanning direction. On the pellet dispensing mechanism, the hooks for the respective colors are arranged at an interval L in the main scanning direction. The value L is greater than the value R. The carriage is scanningly movable in the main scanning direction. The carriage is moved in the direction B or C to be stopped at an appropriate position with respect to the ink case and the pellet dispensing mechanism. When all the hooks are moved, only a selected one hook slides against a corresponding hook abutting protrusion, and pivots. As a result, one pressing body, which is located above a selected discharging section, is pivoted to downwardly press one ink pellet to a corresponding hopper.

41 Claims, 23 Drawing Sheets

INK SUPPLY DEVICE

BACKGROUND OF THE INVENTION

1. Field of the Invention

The present invention relates to an ink supply device and its drive system used in an ink jet printer.

2. Description of the Related Art

An ink jet printer includes a recording head portion for ejecting liquid ink, a carriage mounted with the recording head portion, a mechanism for transporting the carriage in a main scanning direction, and another mechanism for transporting a recording sheet, such as a sheet of paper, in an auxiliary scanning direction, which is perpendicular to the main scanning direction.

Conventional hot melt ink jet printers use hot melt ink that is solid at room temperature and liquid when melted. The hot melt ink can be provided in pellet form. The recording head portion of hot melt ink jet printers includes: a nozzle head formed with a plurality of nozzles, a hopper portion for receiving and melting the ink pellets, and a heater for maintaining the melted condition of the hot melt ink. During printing, the carriage is transported in the main scanning direction while the recording head portion is driven to eject hot melt ink droplets from the nozzles of the nozzle head so that desired characters and/or images can be printed on the surface of the recording sheet.

When the recording head portion runs out of ink, the user has to drop some ink pellets into the hopper portion. The ink pellets are melted by the heater so the ink can be ejected from the nozzle head. When replenishing the ink pellets, the operator therefore has to pick up the ink pellets by hand. Accordingly, grime and oil from the operator's fingers can cling to the ink pellets and degrade the quality of the hot melt ink.

U.S. Pat. No. 4,823,146 has proposed a method for enabling replenishment of the ink pellets without requiring the user to directly touch the ink pellets.

According to this method, a flexible ink holder is provided to house an ink pellet therein. The flexible ink holder is formed from a flexible material. One end of the ink holder is open, and covered with a material, such as aluminum foil, that tears when applied with pressure. A plurality of different types of ink holders are provided, each housing a different colored ink pellet.

To supply an ink pellet, the user selects an ink holder containing a desired color of ink pellet. Then, the user places the ink holder against the opening of the hopper for the corresponding color so that the aluminum foil cover presses against the hopper opening. The user then fixes the ink holder in place in this posture. Then, the user presses against the rear side of the ink holder and presses toward the sealed portion. As a result, the rear side of the ink holder presses against the ink pellet, which in turn presses against and tears the aluminum foil cover. This configuration enables the user to replenish ink pellets without directly touching them.

SUMMARY OF THE INVENTION

With the ink supply method proposed in U.S. Pat. No. 4,823,146, however, the operator still has to manually supply ink pellet holders to the ink jet printer. Accordingly, maintenance of the ink jet printer is still troublesome.

It is conceivable to provide an ink supply device for supplying liquid ink or ink pellets to the ink jet printer. The ink supply device may be designed to include separate ink cartridges for each type of different colored ink. When the ink jet printer runs out of ink, the carriage is positioned below the ink supply device. The operator manually operates the ink supply device so that an appropriate amount of ink or one or more ink pellet is supplied from a corresponding ink cartridge into the corresponding hopper portion. This manual operation is, however, still troublesome.

It is also conceivable to provide the ink supply device with an automatic ink discharging mechanism for automatically discharging liquid ink or ink pellets from the ink supply device to the hopper portions.

In order to provide the full color printer with this conceivable automatic ink discharging mechanism, however, a separate drive mechanism has to be provided for driving the ink discharging mechanism for each different color. These extra drive mechanism increases manufacturing costs of the printer.

It is therefore an object of the present invention to provide an ink supply device, which is capable of being driven with a simple driving mechanism to selectively and automatically supply liquid ink or ink pellets to the recording head.

Another object of the present invention is to provide an ink jet printer which is provided with the ink supply device and which still has a simple structure.

In order to attain the above and other objects, the present invention provides an ink supply device for use in an ink jet printer, the ink supply device comprising: a carriage capable of being moved in a scanning direction within a scanning region, the scanning region including an ink supply region, the carriage being provided with a plurality of hoppers for receiving ink of a plurality of different colors, respectively, the hoppers being arranged in the scanning direction; an ink storing unit, disposed in the ink supply region, for storing ink of the plurality of different colors, the ink storing unit including a plurality of ink supplying portions each for supplying ink of a corresponding color, the plurality of ink supplying portions being arranged in the scanning direction, distances between the ink supply portions along the scanning direction being different from distances between the hoppers on the carriage along the scanning direction; and a carriage scanning control mechanism for controlling the carriage to move in the scanning direction, the carriage scanning control mechanism selectively stopping the carriage at positions relative to the ink storing unit, thereby selectively controlling the ink supplying portions to supply ink of the corresponding colors from the ink storing unit to the corresponding hoppers according to the stopping positions of the carriage.

The hoppers may be arranged in the scanning direction at a first interval in the scanning direction, and the plurality of ink supplying portions may be arranged in the scanning direction at a second interval, the second interval being different from the first interval.

The ink supply device may further comprise an ink supply control unit disposed in the ink supply region, the ink supply control unit being capable of causing each ink supplying portion to supply a corresponding hopper with ink of a corresponding color, the ink supply control unit causing a selected one ink supply portion to supply its corresponding hopper with ink of the corresponding color in accordance with the stopping position of the carriage.

According to another aspect, the present invention provides an ink Jet printer, comprising: a carriage capable of being moved in a scanning direction within a scanning region, the scanning region including an ink supply region and a printing region, the carriage being provided with a plurality of hoppers for receiving ink of a plurality of different colors, respectively, the hoppers being arranged in the scanning direction, the carriage being further provided with a recording head portion capable of ejecting ink received in the plurality of hoppers; a sheet transport mechanism for transporting a recording sheet in a sheet transport direction orthogonal to the scanning direction, the sheet transport mechanism transporting the sheet in the printing region along the scanning direction; an ink storing unit, disposed in the ink supply region, for storing ink of the plurality of different colors, the ink storing unit including a plurality of ink supplying portions each for supplying ink of a corresponding color, the plurality of ink supplying portions being arranged in the scanning direction, distances between the ink supplying portions along the scanning direction being different from distances between the hoppers along the scanning direction; and a carriage scanning control mechanism for controlling the carriage to move in the scanning direction, the carriage scanning control mechanism selectively stopping the carriage at positions relative to the ink storing unit, thereby selectively controlling the ink supplying portions to supply ink of the corresponding colors from the ink storing unit to the corresponding hoppers according to the stopping positions of the carriage.

According to still another aspect, the present invention provides an ink supply device for use in an ink jet printer, the ink supply device comprising: a carriage, capable of being scanned in a scanning direction, the carriage being provided with a plurality of hoppers for receiving a plurality of different colored inks, the hoppers being disposed on the carriage and aligned in the scanning direction separated by first distances in the scanning direction; a carriage scanning mechanism for scanning the carriage in the scanning direction within a scanning region, the scanning region including an ink supply region; an ink case, disposed at the ink supply region, for storing the plurality of different colored inks, the ink case being formed with a plurality of ink discharging portions capable of discharging the plurality of different colored inks stored in the ink case, the ink discharging portions being aligned in the scanning direction and separated from one another by second distances different from the first distances; and an ink discharge control mechanism for controlling the carriage scanning mechanism to selectively stop scanning movement of the carriage in the scanning direction and selectively discharging each color ink from a corresponding discharging portion to the corresponding hopper according to stopping position of the carriage in the scanning direction.

According to another aspect, the present invention provides an ink jet printer comprising: a sheet transport mechanism for transporting a recording sheet in a sheet transport direction; a carriage, capable of being scanned in a scanning direction different from the sheet transport direction, the carriage being provided with a plurality of hoppers for receiving a plurality of different colored inks, the hoppers being disposed on the carriage and aligned in the scanning direction separated by first distances in the scanning direction, the carriage being further provided with a recording head portion for ejecting ink onto a surface of a recording sheet; a carriage scanning mechanism for scanning the carriage in the scanning direction within a scanning region, the scanning region including an ink supply region; an ink case, disposed at the ink supply region, for storing the plurality of different colored inks, the ink case being formed with a plurality of ink discharging portions capable of discharging the plurality of different colored inks stored in the ink case, the ink discharging portions being aligned in the scanning direction and separated from one another by second distances different from the first distances; and an ink discharge control mechanism for controlling the carriage scanning mechanism to selectively stop scanning movement of the carriage in the scanning direction and selectively discharging each color ink from a corresponding discharging portion to the corresponding hopper according to stopping position of the carriage in the scanning direction.

The ink discharge control mechanism may include: a scanning control mechanism for controlling the carriage scanning mechanism to selectively stop scanning movement of the carriage in the scanning direction; and a discharge control mechanism for selectively discharging each color ink from a corresponding discharging portion to the corresponding hopper according to stopping position of the carriage in the scanning direction.

The ink jet printer may further comprise: a clutch for selectively driving the discharge control mechanism; a single drive source for providing rotational power; a power driven unit capable of receiving power and operating upon reception of power; and a power transmission portion for dividing rotational power from the drive source and for selectively transmitting the rotational power to an upstream side of the clutch and to the power driven unit, wherein the clutch includes switching means for switching the clutch into an ON condition, wherein rotational power from the power source is transmitted to the discharge control mechanism, and an OFF condition, wherein rotational power from the power source is not transmitted to the discharge control mechanism, according to movement of the carriage toward and away from the ink supply region.

BRIEF DESCRIPTION OF THE DRAWINGS

The above and other objects, features and advantages of the invention will become more apparent from reading the following description of the preferred embodiment taken in connection with the accompanying drawings in which:

FIG. 6(*b*) is a sectional view of a portion of the ink case of FIG. 6(*a*);

FIG. 17(*b*) is a plan view showing the hook abutting protrusion for cyan (C) colored ink pellets aligned with the the corresponding hook;

FIG. 17(*c*) is a plan view showing the hook abutting protrusion for magenta (M) colored ink pellets aligned with the corresponding hook;

FIG. 17(*d*) is a plan view showing the hook abutting protrusion or yellow (Y) colored ink pellets aligned with the corresponding hook;

FIG. 20(*b*) is a plan view showing the clutch brought into an ON condition by movement of a pressing rib;

FIG. 22(*b*) is a plan view showing how the clutch is returned the OFF condition through the operation of the pressing rib.

DETAILED DESCRIPTION OF THE PREFERRED EMBODIMENT

Figure 1:
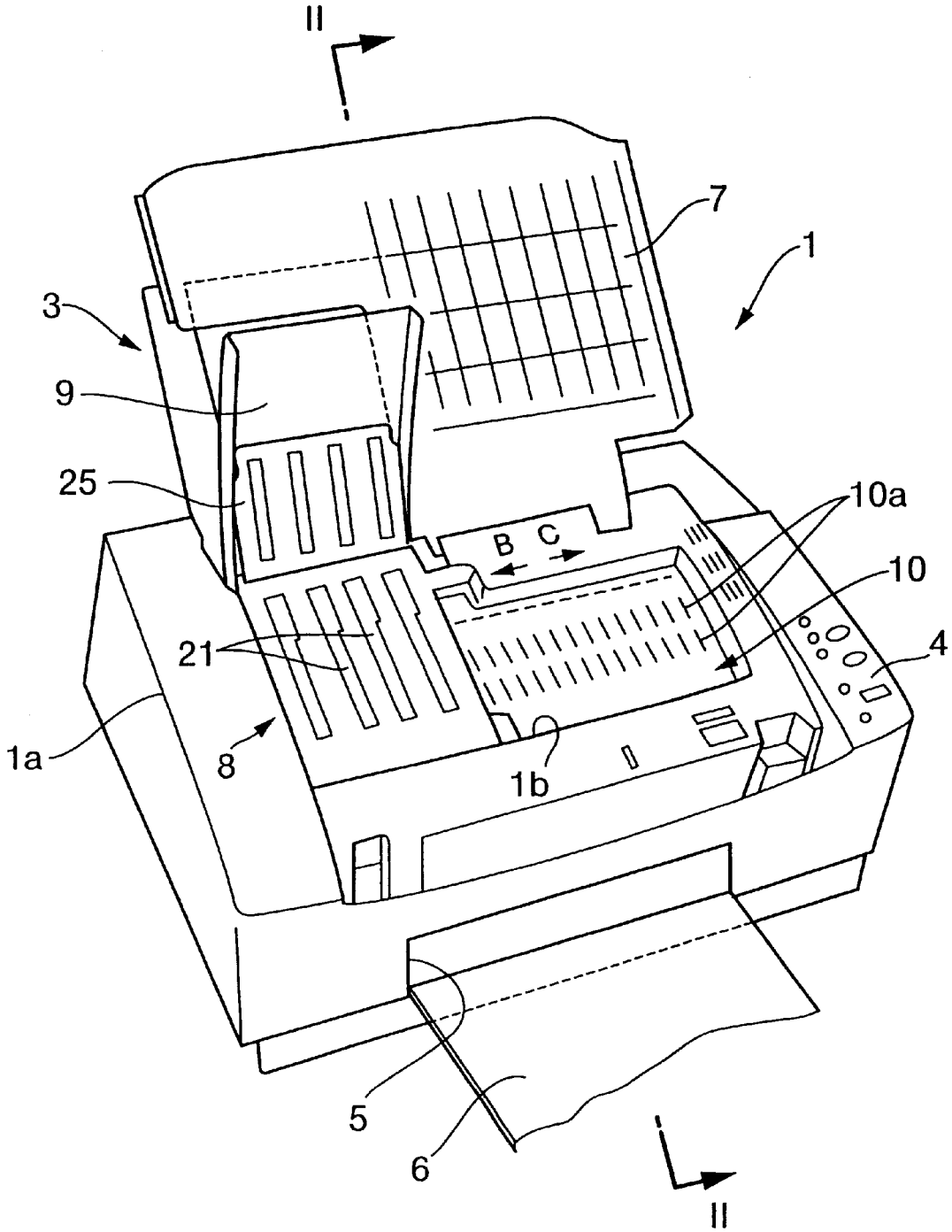
FIG. 1 is a perspective view showing a hot melt ink jet printer according to an embodiment of the present invention.

An ink supply device according to a preferred embodiment of the present invention will be described while referring to the accompanying drawings wherein like parts and components are designated by the same reference numerals to avoid duplicating description.

FIG. 1 is a perspective view showing a hot melt ink jet printer 1 according to the embodiment of the present invention.

Directional terms, such as up, down, right, and left, will be used in the following description with reference to the state of the printer 1 located in an orientation shown in FIG. 1.

Figure 2:
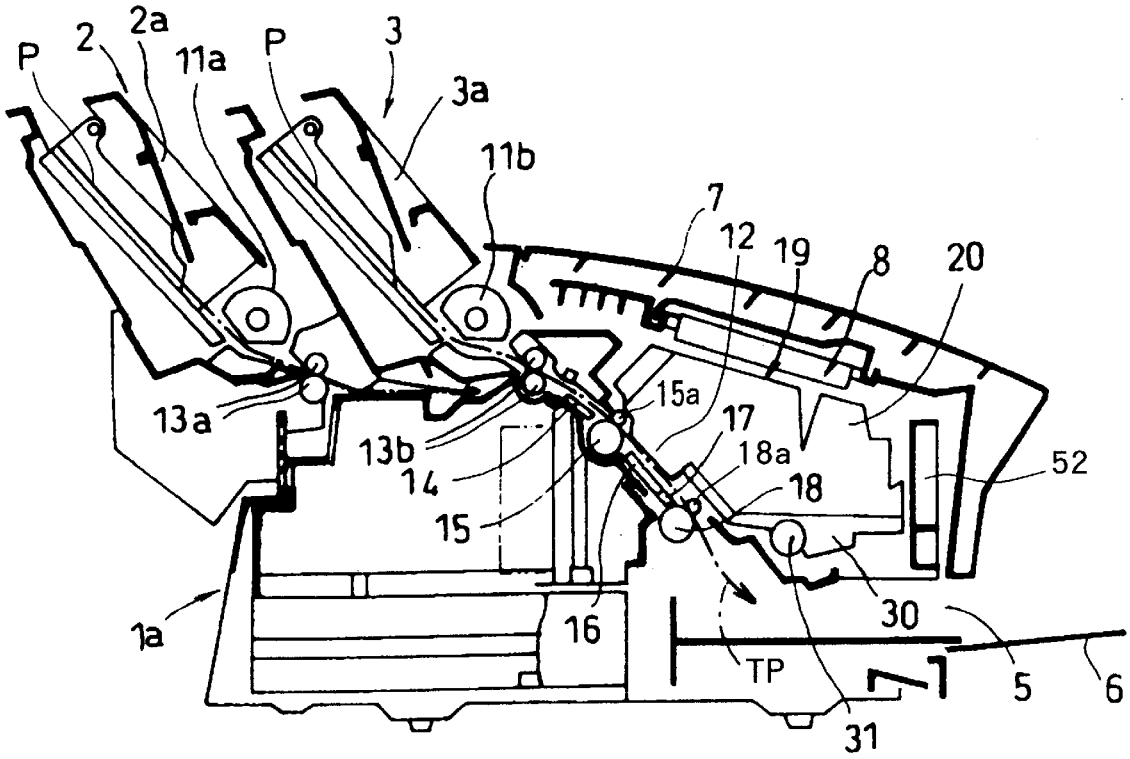
FIG. 2 is a cross-sectional view showing the printer of FIG. 1 taken along a line II—II.

FIG. 2 is a cross-sectional view of the printer 1 shown in FIG. 1 taken along a line II—II.

As shown in FIG. 1, the printer 1 includes a case 1*a*. The case 1*a* is formed with a central opening 1*b* at its upper surface. An external cover 7 is provided to freely open and close to cover the central opening 1*b*. An operation panel 4 is provided to the upper right surface of the case 1*a*. The operation panel 4 is formed with a variety of operation switches.

Figure 6:
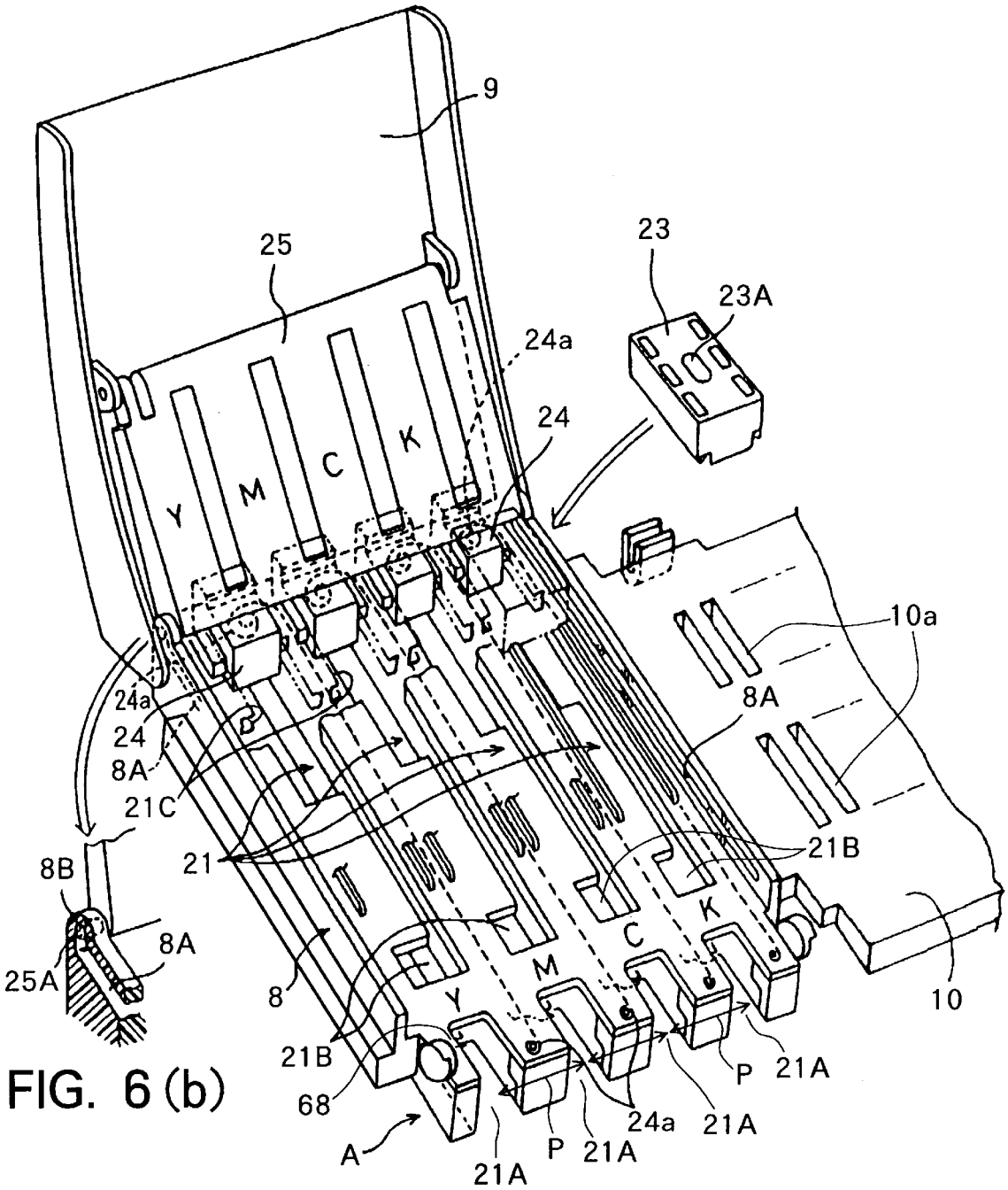
FIG. 6(*a*) is a perspective view showing an ink case used for holding ink pellets for the printer of FIG. 1.

An ink case 8 shown in FIG. 6(*a*) is freely and detachably mounted in the left portion of the central opening 1*b*. The ink case 8 has a cover 9 enabling the ink case 8 to be opened and closed. The ink case 8 separately stores yellow (Y), magenta (M), cyan (C), and black (K) ink pellets 22 shown in FIG. 7. The different colored ink pellets 22 are made for use in the color ink jet printer 1.

A transparent cover 10 is fixed in the right portion of the central opening 1*b*, that is, to the right side of the ink case 8. The transparent cover 10 protrudes horizontally in the rightward direction. The transparent cover 10 is formed with a plurality of vent through-holes 10*a*.

As shown in FIG. 2, sheet supply units 2 and 3 are freely and detachably provided to the upper rear surface of the case 1*a*. Each of the sheet supply units 2 and 3 is filled with a stack of recording sheets P, such as cut sheets or transparent film used for overhead projectors. Insert trays 2*a* and 3*a* are attached to the upper surfaces of the sheet supply units 2 and 3, respectively, so that a user can manually insert recording sheets into the printer 1.

A sheet discharge port 5 is formed in the front surface of the case 1*a*. Recording sheets P printed by the printer 1 are discharged through the sheet discharge port 5. A discharge tray 6 is disposed under the sheet discharge port 5 so that sheets discharged through the discharge port 5 accumulate on the discharge tray 6.

As shown in FIG. 2, a pair of sheet supply rollers 11*a* and 11*b*, each of which has substantially a D-shaped cross-section, are disposed at the lower edges of the sheet supply units 2 and 3, respectively. The sheet supply roller 11*a* is provided for feeding one sheet out of recording sheets P, that is, either those stacked in the sheet supply unit 2 or manually fed in through the insert tray 2*a*, toward a sheet transport pathway TP provided inside the case 1*a*. Similarly, the sheet supply roller 11*b* is provided for feeding one sheet out of recording sheets P, that is, either those stacked in the sheet supply unit 3 or manually fed in through the insert tray 3*a*, toward the sheet transport pathway TP.

Figure 3:
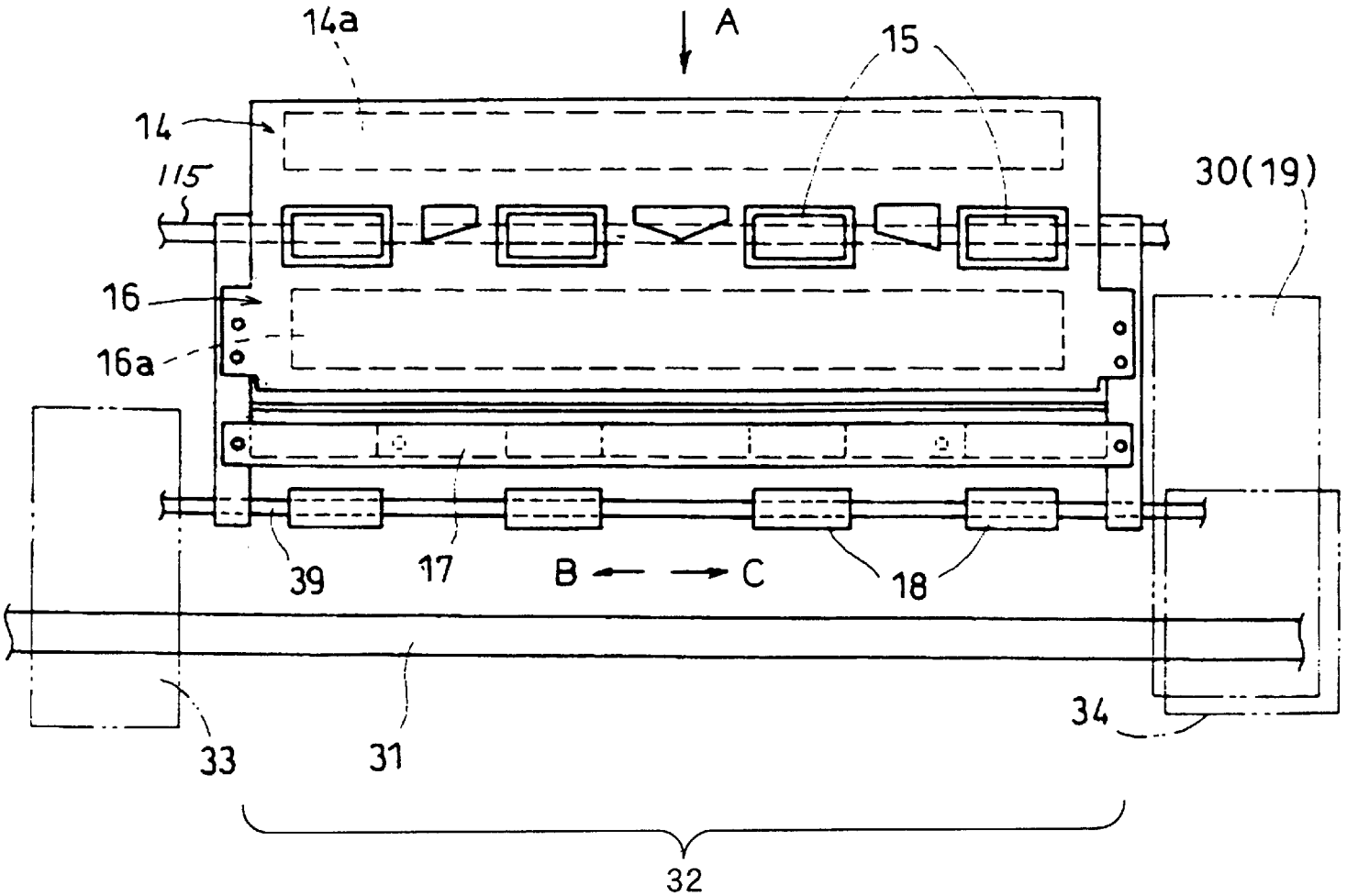
FIG. 3 is a plan view showing a positional relationship among an ink supply portion, a printing portion, and a maintenance operation portion.

The sheet transport pathway TP is defined by a variety of components: a pair of resist rollers 13*a*, the other pair of resist rollers 13*b*, a preheat platen 14, a group of transport rollers 15 and their pinch rollers 15*a*, a main platen 16, a cooling platen 17, a group of discharge rollers 18 and their pinch rollers 18*a*, the sheet discharge port 5, and the discharge tray 6. As shown in FIG. 3, the preheat platen 14 and the main platen 16 are respectively provided with heaters 14*a* and 16*a* for heating the recording sheets P.

Figure 4:
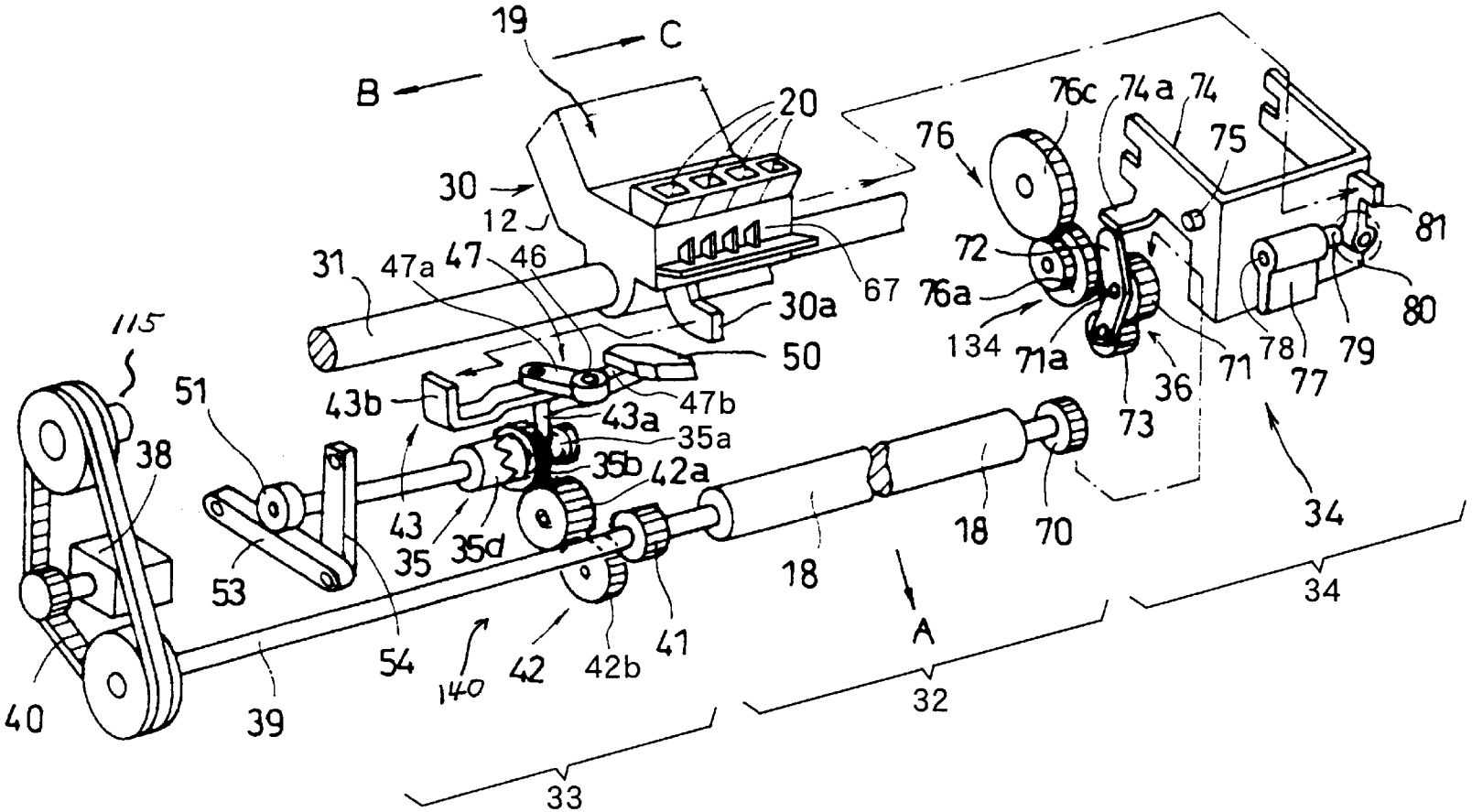
FIG. 4 is an exploded view showing a carriage, a first power transmission mechanism with a clutch, and a second power transmission mechanism with another clutch.

As shown in FIGS. 3 and 4, the group of discharge rollers 18 are mounted on a single drive shaft 39, which is driven by a drive motor 38 via a power transmission mechanism (timing belt) 40. The discharge rollers 18 are mounted on the drive shaft 39 as separated by a predetermined distance. Also as shown in FIGS. 3 and 4, the group of transport rollers 15 are mounted on a single shaft 115, which is driven by the drive motor 38 via the power transmission mechanism (timing belt) 40. The transport rollers 15 are mounted on the shaft 115 as separated by a predetermined distance.

As shown in FIGS. 2–4, a guide shaft 31 is provided to extend parallel to the drive shaft 39. The carriage 30 is mounted on the guide shaft 31 so as to be slidably movable in a main scanning direction (indicated by arrows B and C in FIGS. 3 and 4), which is perpendicular to an auxiliary scanning direction A, in which recording sheets P are transported along the transport pathway TP.

Figure 5:
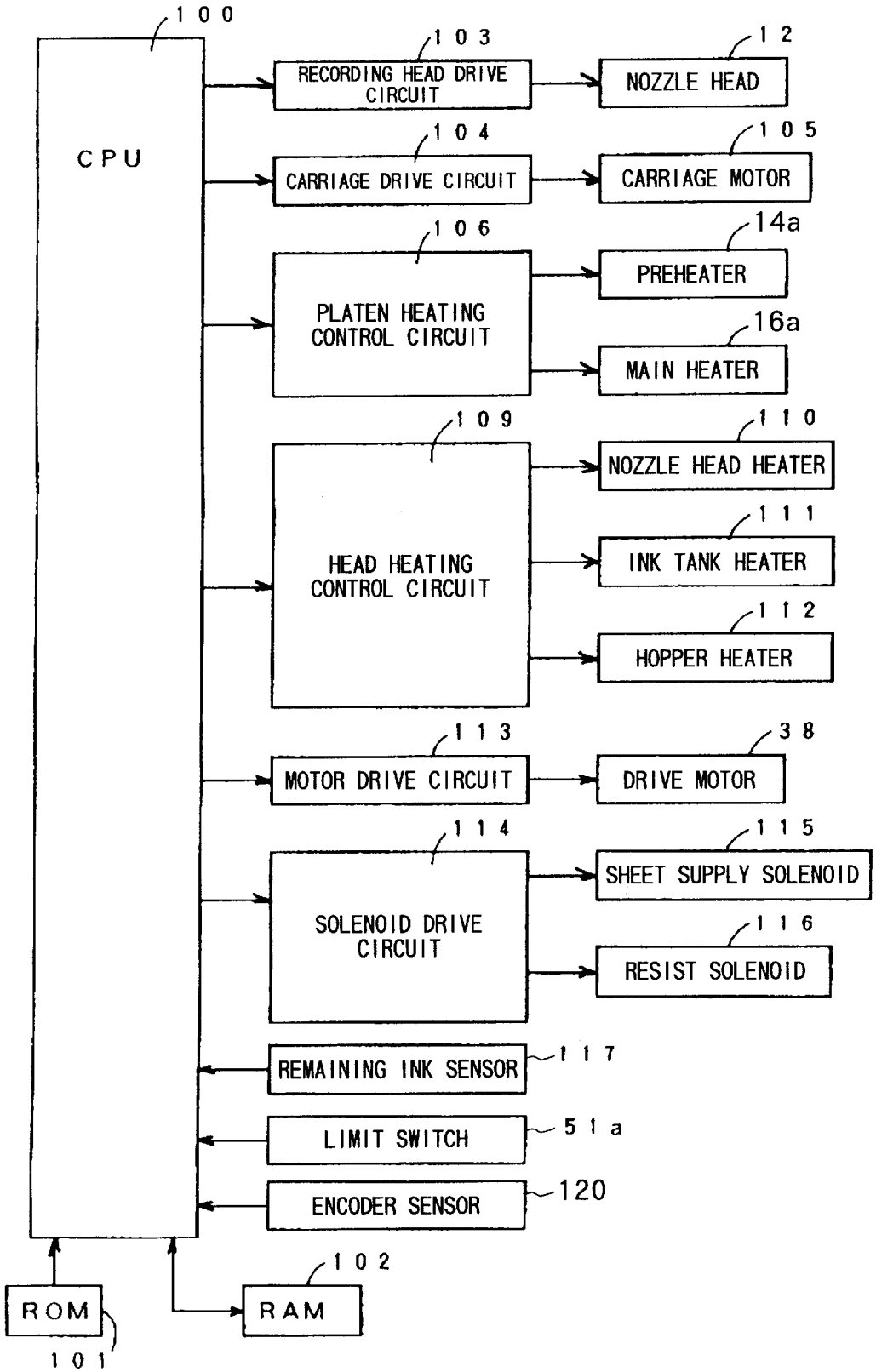
FIG. 5 is a black diagram showing a control system of the printer of FIG. 1.

As shown In FIGS. 2 and 4, the carriage 30 is mounted with a recording head portion 19. The recording head portion 19 includes: a nozzle head 12 on its rear surface; and four ink melting hoppers 20 on its front surface. Although not shown in the drawings, the recording head portion 19 is provided with four ink tanks (not shown) in fluid communication with both the nozzle head 12 and the ink melting hoppers 20. As shown in FIG. 5, the recording head portion 19 is further provided with: a nozzle head heater 110 for heating the nozzle head 12; an ink tank heater 111 for heating the ink tanks; and hopper heaters 112 provided in the respective hoppers 20.

Although not shown in FIG. 4, a guide rail is provided parallel to the guide shaft 31 for guiding movement of the carriage 30 along the guide shaft 31. An encoder sensor 120 (FIG. 5) is attached to the carriage 30 for issuing an encoder signal indicative of the position of the carriage along the guide shaft 31. As shown in FIG. 5, a carriage drive circuit 104 and a carriage motor 105 are provided for moving the carriage 30 reciprocally in the main scanning direction based on the encoder signal. The carriage 30 thus moves along the guide shaft 31 so that the nozzle head 12 on the carriage 30 be located in confrontation with the upper surface of the main platen 16. As shown in FIG. 4, the carriage 30 is formed, at its front side surface, with a pressing rib 30*a* and four hook abutting protrusions 67.

With the above-described structure, a recording sheet P introduced into the printer 1 by the sheet supply roller 11*a* or 11*b* is transported along the sheet transport pathway TP. The sheet P is first heated from its lower surface by the heater 14*a* disposed at the preheat platen 14. When the sheet P reaches the nozzle head 12, the sheet P is heated from its lower surface by the heater 16*a* disposed at the main platen 16. Simultaneously, the nozzle head 12 is controlled to eject hot melt ink toward the upper surface of the recording sheet P so that the ejected hot melt ink impinges on the upper surface of the recording sheet P.

While the recording sheet P is transported to the discharge rollers 18, the hot melt ink impinged thereon solidifies on the surface of the recording sheet P so that the hot melt ink is not transferred to the surface of the pinch rollers 18*a*. Afterward, the printed recording sheet P is discharged onto the discharge tray 6.

Figure 13:
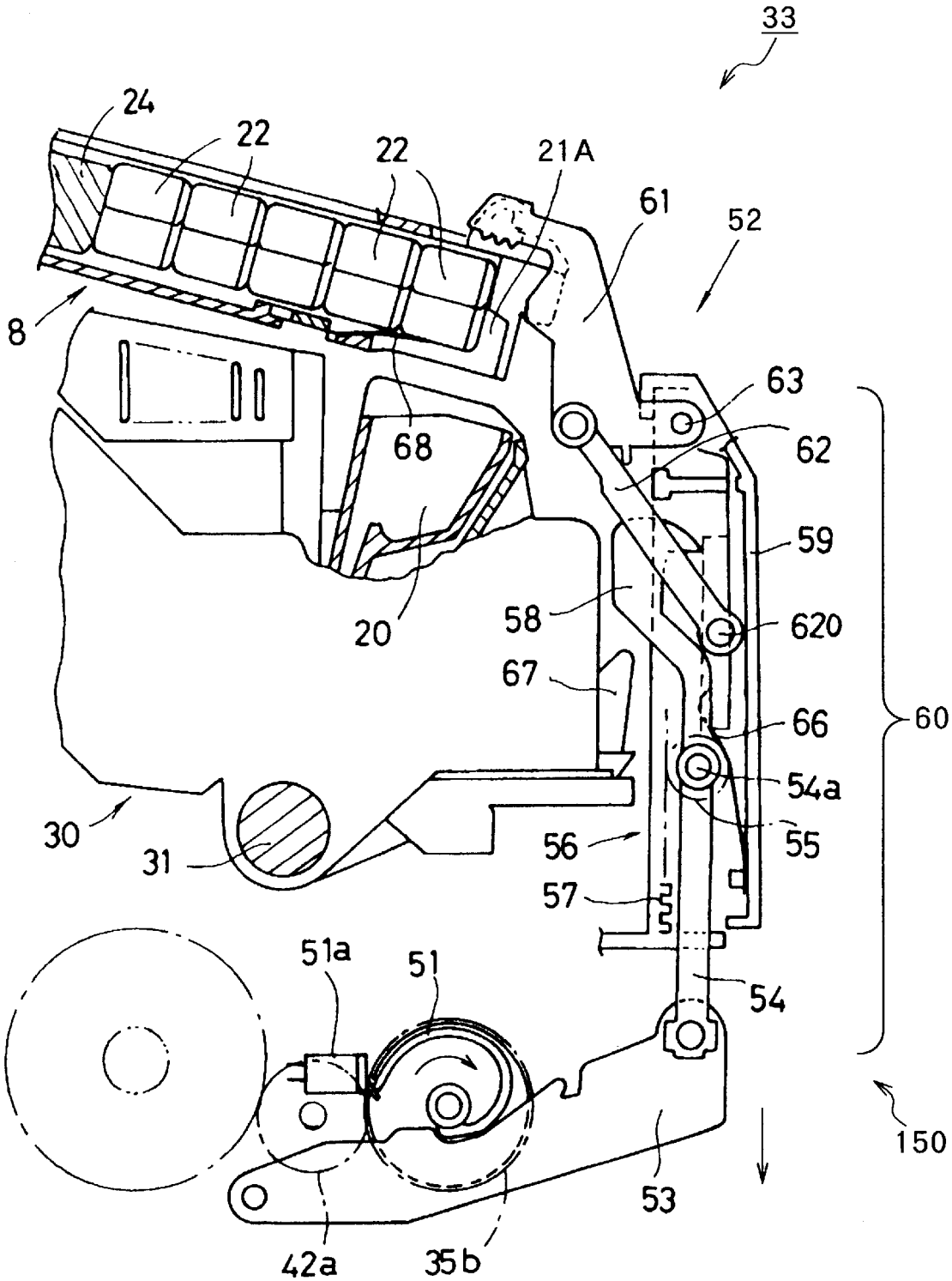
FIG. 13 is a side view in a partial cross section showing the ink case and a pellet dispensing mechanism in the ink supplying portion.

As shown in FIG. 3, the printer 1 has: a printing portion 32, an ink supply portion 33, and a maintenance operation portion 34. The printing portion 32 is located as confronting the platens 14 and 16 and the discharge rollers 18 so as to perform ink printing operation. The ink supply portion 33 is disposed at the left side of the printing portion 32. The maintenance operation portion 34 is disposed at the right side of the printing portion 32. The ink supply portion 33 is provided for selectively supplying ink pellets to the hoppers 20 on the carriage 30 that have run out of ink. As will be described later, the ink case 8 and a pellet dispensing mechanism 52 are provided in the ink supply portion 33 as shown in FIG. 13. The maintenance operation portion 34 is provided for intermittently rolling up a roll of paper (not shown) while subjecting the nozzle head 12 to purging operation and for wiping ink and the like of the nozzle surface of the nozzle head 12. As shown in FIG. 4, a gear 76*c* for performing the maintenance operation is provided in the maintenance operation portion 34.

The guide shaft 31 is disposed so as to extend entirely through the ink supply portion 33, the printing portion 32, and the maintenance operation portion 34. Accordingly, the carriage 30 can be moved not only in the printing portion 32, but also in the ink supply portion 33 and in the maintenance operation portion 34.

The drive shaft 39 is also disposed so as to extend through the ink supply device 33, the printing portion 32, and the maintenance operation portion 34. The drive shaft 39 can therefore transmit power from the single motor 38 to: the printing portion 32; the ink supply portion 33; and the maintenance operation portion 34.

FIG. 5 is a block diagram showing a control system for the hot melt ink jet printer 1. A CPU 100 is connected to a variety of components including a ROM 101, a RAM 102, a recording head drive circuit 103, the carriage drive circuit 104, a platen heating control circuit 106, a head heating control circuit 109, a motor drive circuit 113, a solenoid drive circuit 114, a remaining ink amount sensor 117, the encoder sensor 120, and a limit switch 51*a*. A variety of detection signals are inputted to the CPU 100 from these components.

The ROM 101 is prestored with a variety of control programs to be executed by the CPU 100 to perform computations for printing color images based on print data transmitted from a host computer (not shown) connected to the printer 1. The recording head drive circuit 103 is for driving the nozzle head 12 based on the print data. The carriage drive circuit 104 is for driving a carriage motor 105 to reciprocally move the carriage 30 in the main scanning direction in accordance with the encoder signal issued from the encoder sensor 120.

The platen heating control circuit 106 is for driving the preheater 14*a* and the main heater 16*a*, which are provided to the lower surface of the preheat platen 14 and the main platen 16, respectively, to maintain them at a predetermined temperature.

The head heating control circuit 109 is for controlling energization of the nozzle head heater 110, the ink tank heater 111, and the hopper heaters 112. The nozzle head heater 110 heats the nozzle head 12. The ink tank heater 111 heats ink in the melting ink tanks. The hopper heaters 112 heat the ink pellets 22 supplied to the melting hoppers 20 to melt the ink pellets 22 into liquid state.

The motor drive circuit 113 is for driving the drive motor 38, which is reversibly rotatable and is made from a step motor.

The solenoid drive circuit 114 is for driving a sheet supply solenoid 115 and a resist solenoid 116. The sheet supply solenoid 115 is for selecting driving of the sheet supply rollers 11*a* and 11*b* to feed a recording sheet P to the sheet transport pathway TP. The resist solenoid 116 is for temporarily stopping rotation of the pair of resist rollers 13*a* and 13*b*.

The remaining ink amount sensor 117 is for detecting residual amount of ink remaining in the ink tanks on the carriage 30. The remaining ink amount sensor 117 is adapted to detect, for each color ink, that ink in the corresponding ink tank has run out when only a certain amount remains.

The ROM 101 also previously stores therein programs for executing a variety of control operations such as motor drive operations. The ROM 101 also stores predetermined carriage position data used for positioning the carriage 30 into the ink supply portion 33, the print portion 32, and the maintenance operation portion 34.

According to the present embodiment, the carriage position data is calculated based on the number of encoder pulses to be issued from the encoder sensor 120. Accordingly, the ROM 101 previously stores therein the predetermined carriage position data as certain encoder values. The ROM 101 also previously stores therein, as certain encoder values, other predetermined carriage position data to be used for switching clutches 35 and 36 (FIG. 4) into ON and OFF and for supplying desired color ink pellets to the hoppers 20 as will be described later. For example, the ROM 101 stores carriage position data indicative of positions X1–X3 shown in FIGS. 20(*a*) and 20(*b*) and ink supply positions S1–S4 shown in FIGS. 17(*a*)–17(*d*) as will be described later.

The RAM 102 is used for temporarily storing print data transmitted from the host computer and also as a work area temporarily used during execution of the various control operations.

Next, the ink supplying portion 33 will be described below in greater detail. As described above, the ink case 8 and the pellet discharging mechanism 52 are provided in the ink supplying portion 33 as shown in FIG. 13.

The configuration of the ink case 8 will be first described while referring to FIGS. 6(*a*)–12.

FIG. 6(*a*) is a perspective view showing the ink case 8 used in the printer 1.

Figure 7:
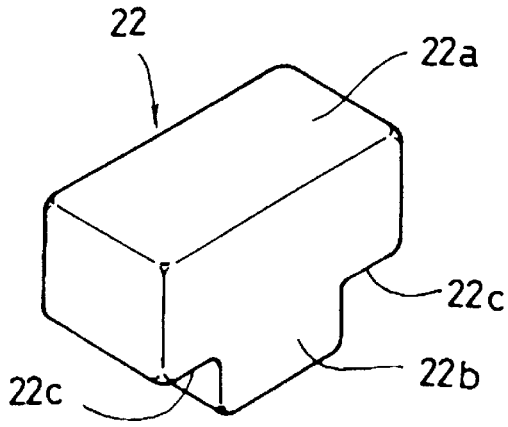
FIG. 7 is a perspective view showing an example of an ink pellet.

The ink case 8 is for storing a plurality of ink pellets 22, an example of which is shown in FIG. 7. Each ink pellet 22 is formed from hot melt ink in solid form. The "hot melt ink" is the general term given to ink that is solid at the room temperature and liquid when heated. Exemplary properties of hot melt ink are a softening point of from 40° C. to 140° C., a melting point of from 50° C. to 150° C., and a viscosity of between 3 to 50 CPS when ejected as a liquid from the nozzles of the nozzle head. Hot melt ink is desirably formed from 30% to 90% wax, 5% to 70% resin, and 0.1% to 10% coloring. Hot melt ink also includes other materials, such as viscosity increasing agents, surfactants, and solubilizer.

The exemplary ink pellet 22 shown in FIG. 7 has a substantially T-shape and includes an upper portion 22*a* elongated in the horizontal direction and a lower portion 22*b*, which is shorter in the horizontal direction than the upper portion 22*a*. Two step portions 22*c* and 22*c* are formed at the left and right sides of the upper portion 22*a* to provide the ink pellet 22 with this T-shape.

As shown in FIG. 6(*a*), the pivotally openable cover 9 is attached to the rear edge of the ink case 8.

The ink case 8 includes four accommodating channel sections 21 arranged in a row so as to respectively correspond to yellow (Y), magenta (M), cyan (C) and black (K), all of which are ink colors used in the color ink jet printer 1. Each of the accommodating channel sections 21 has: a discharging section 21A for discharging an ink pellet 22 to a corresponding hopper 20 on the carriage 30; a pellet supporting channel 21B for supporting a plurality of ink pellets 22 so as to be movable toward the discharging section 21A; and an insertion section 21C for inserting the ink pellet 22 into the pellet supporting channel 21B. These sections 21A, 21B and 21C are arranged in this order from the side of the ink discharging section A. As shown in FIG. 6(a), the discharging sections 21A of the accommodating channel sections 21 are arranged as separated from one another by a predetermined interval P.

Figure 8:
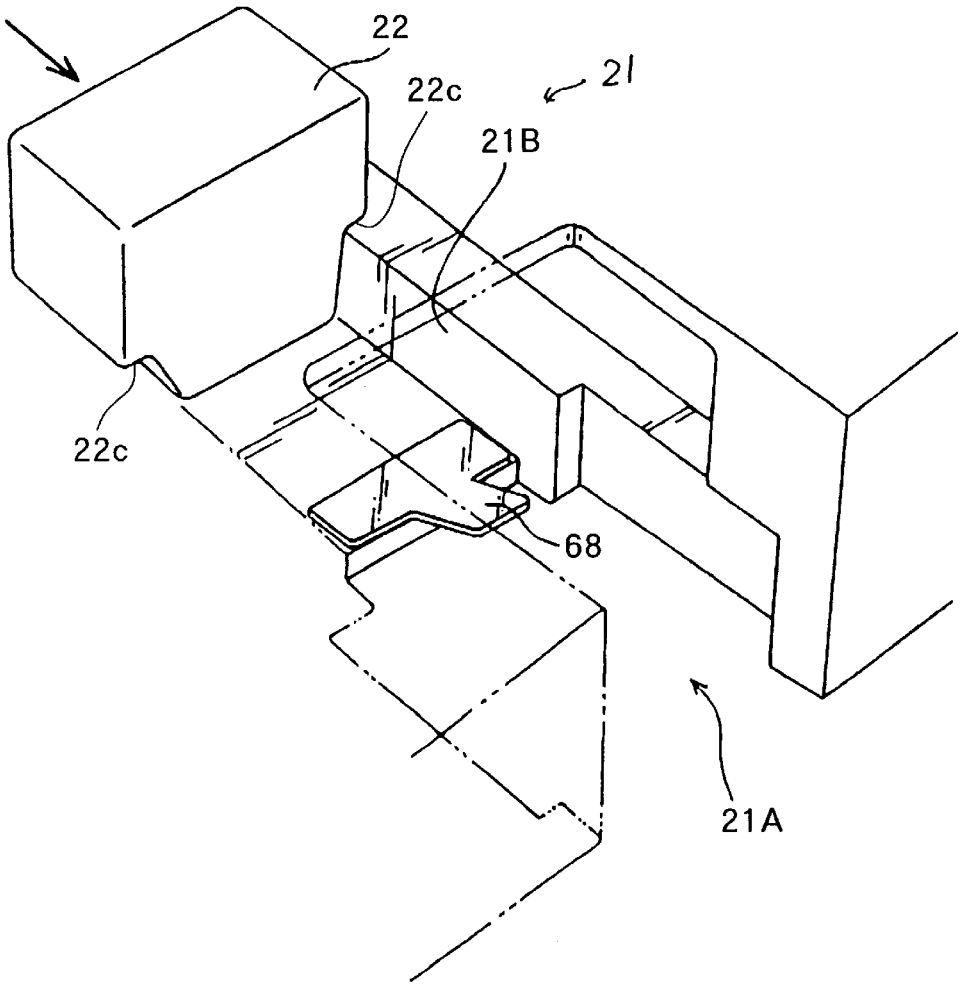
FIG. 8 is an explanatory view showing the ink pellet being moved to a discharging section.

As shown in FIG. 8, ink pellets 22 are fitted in each accommodating channel section 21B with their left and right steps 22*c* and 22*c* being supported on the left and right sides of the channel section 21B so that the ink pellets 22 are movable toward the discharging section 21A.

Figure 9:
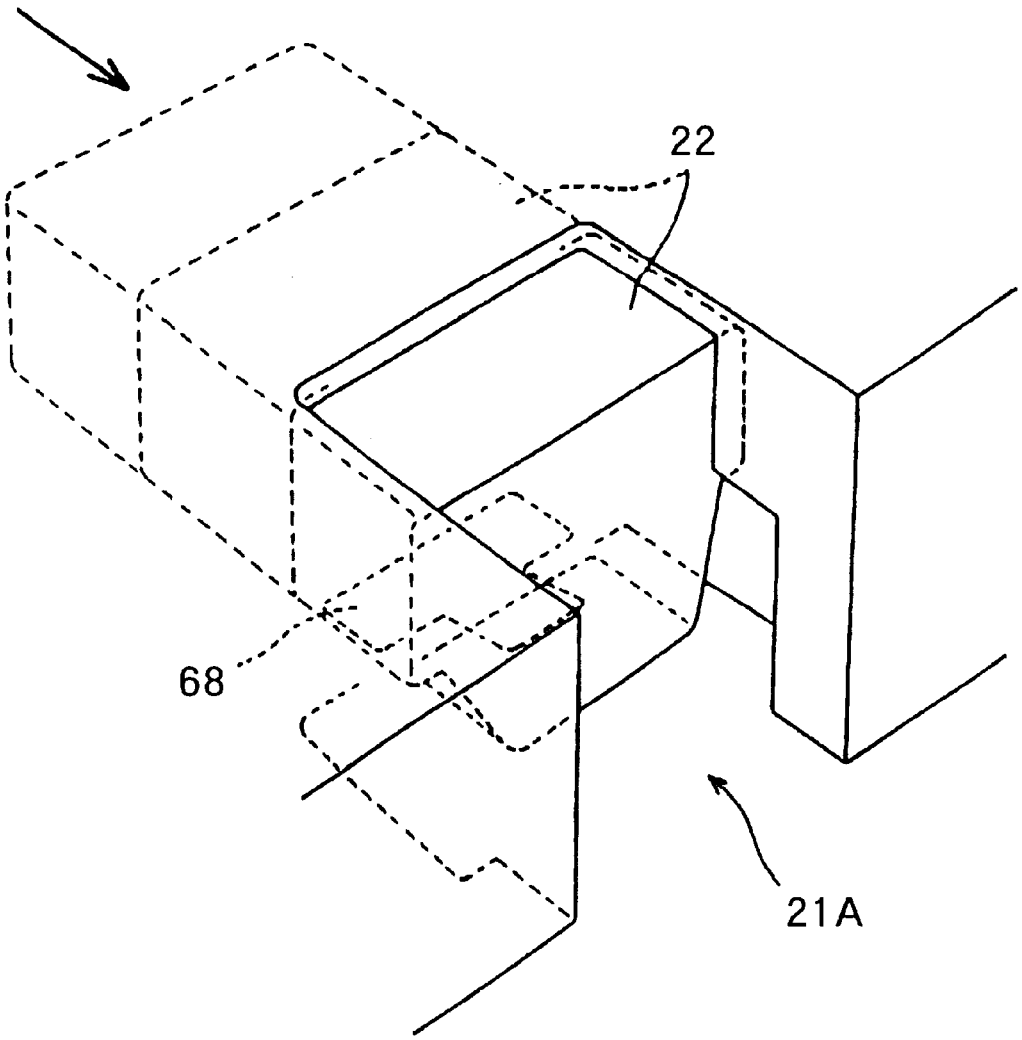
FIG. 9 is an explanatory view showing the ink pellet supported at the discharging section.
Figure 10:
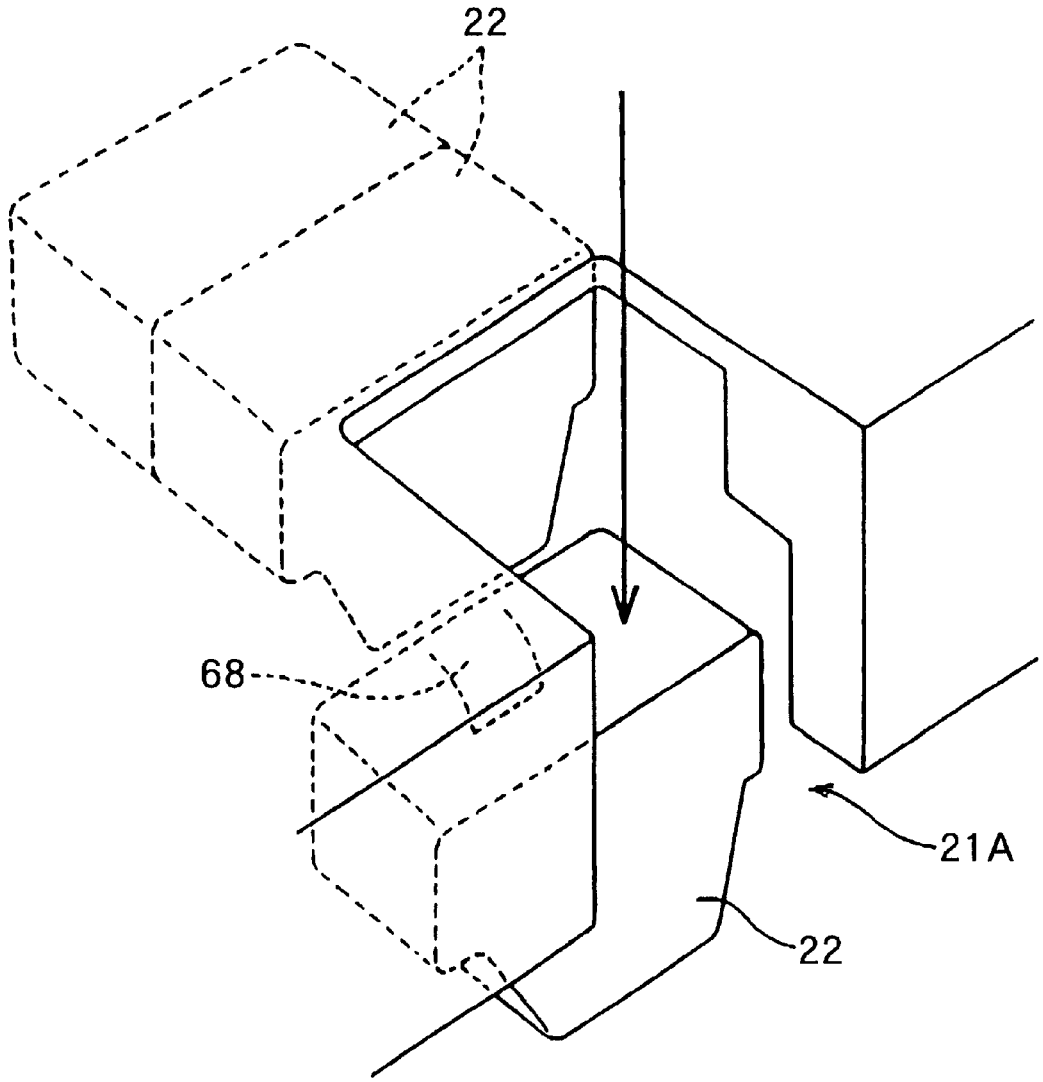
FIG. 10 is an explanatory view showing the ink pellet discharged from the discharging section.

Each of the discharging sections 21A arranged at the side of the supplying section A is open from an upper surface to a lower surface of the ink case 8 as shown in FIGS. 8 and 9. A pellet supporting plate (resilient support rib) 68 is provided at the lower surface of the discharging section 21A. The pellet supporting plate 68 is for supporting one ink pellet 22, that is moved to the discharging section 21A, as shown in FIG. 9. As shown in FIG. 10, one ink pellet 22, that is supported on the support plate 68, is pressed out of the discharging section 21A downwardly into a melting hopper 20 on the carriage 30 as will be described later.

As shown in FIG. 6(*a*), ink pellets 22, to be set in the case 8, are originally accommodated in an ink holder 23 so as not to be touched by an operator when handled thereby. The ink holder 23 is open at one side (the lower surface in FIG. 6(*a*)), into which the ink pellets 22 can be inserted. The ink holder 23 supports a plurality of, three in this example, ink pellets 22 therein. A pressing concave 23A is formed at the center portion of the other side (the upper surface in FIG. 6(*a*)) of the holder 23. The pressing concave 23A serves as a guide for a user, that is, when a user presses on the pressing concave 23A, the pressing force is distributed to discharge each of the ink pellets 22 accommodated within the ink holder 23.

When desiring to set ink pellets 22 to the case 8, the ink holder 23 is first placed onto the insertion section 21C of a desired accommodating channel 21 as shown in FIG. 6(*a*). Then, all the ink pellets 22 are released from the ink holder 23, whereby the ink pellets 22 fall due to gravity from the ink holder 23 into the pellet supporting channel 21B. As described above, the ink pellets 22 are fitted in the supporting channel 21B with their left and right steps 22*c* and 22*c* being supported on the left and right sides of the channel 21B so that the ink pellets 22 are movable toward the discharging section 21A.

Figure 11:
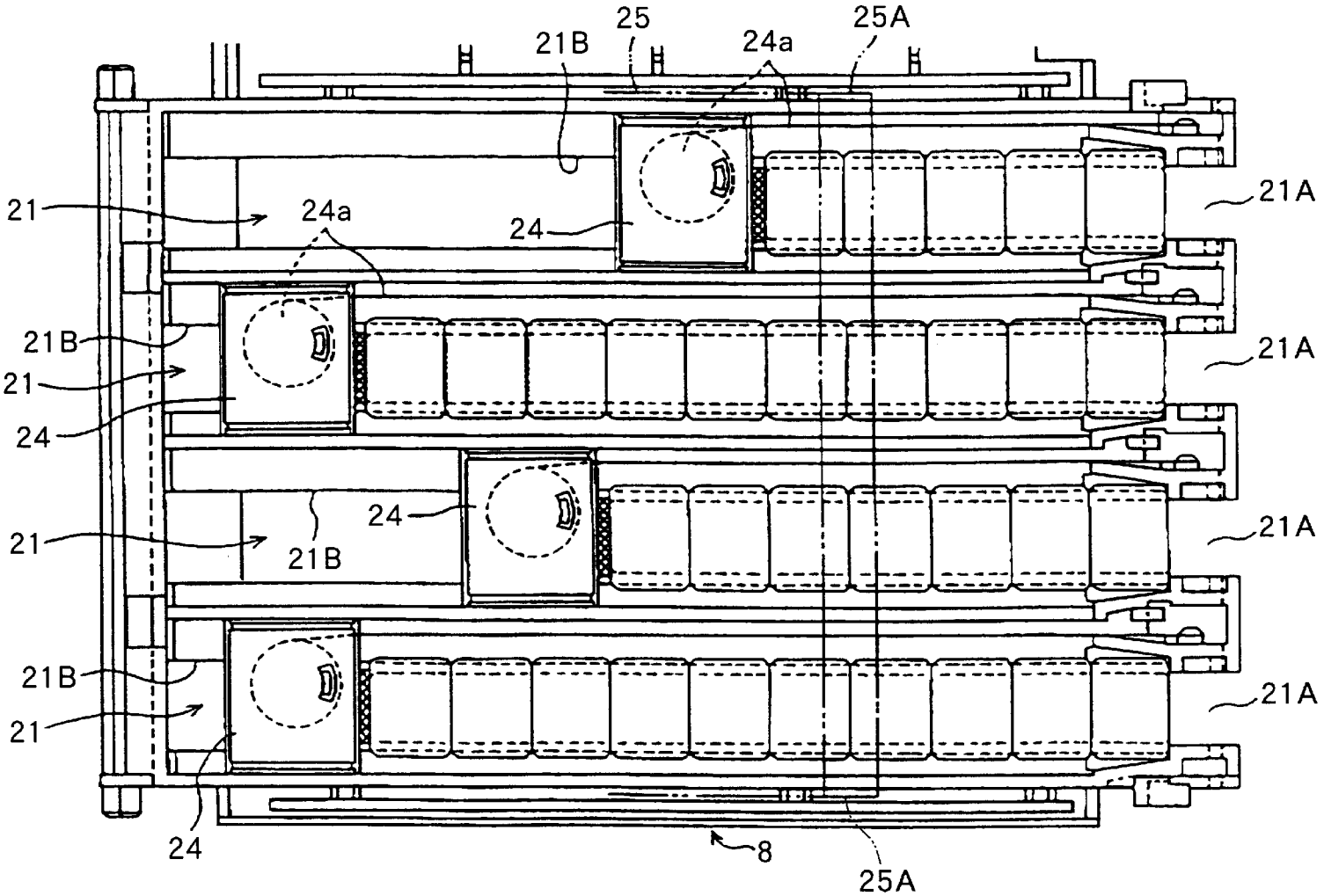
FIG. 11 is an explanatory view showing ink pellets accommodated in each of the accommodating channel section.

The ink pellets 22 thus placed in each pellet supporting channel 21B are, as shown in FIG. 11, urged toward the discharging section 21A by an urging mechanism provided with a pellet pressing member 24 and an urging member 24*a*. The urging mechanism is mounted in each accommodating channel section 21. The pellet pressing member 24 is movable along the pellet supporting channel 21B so as to contact the rear side surface of the ink pellet 22. The urging member 24*a* may include a coil spring for producing a stabilized urging force. The center of the spring is fixed to the pellet pressing member 24 and the leading edge thereof is fixed to the discharging section 21A of the accommodating channel section 21.

Figure 12:
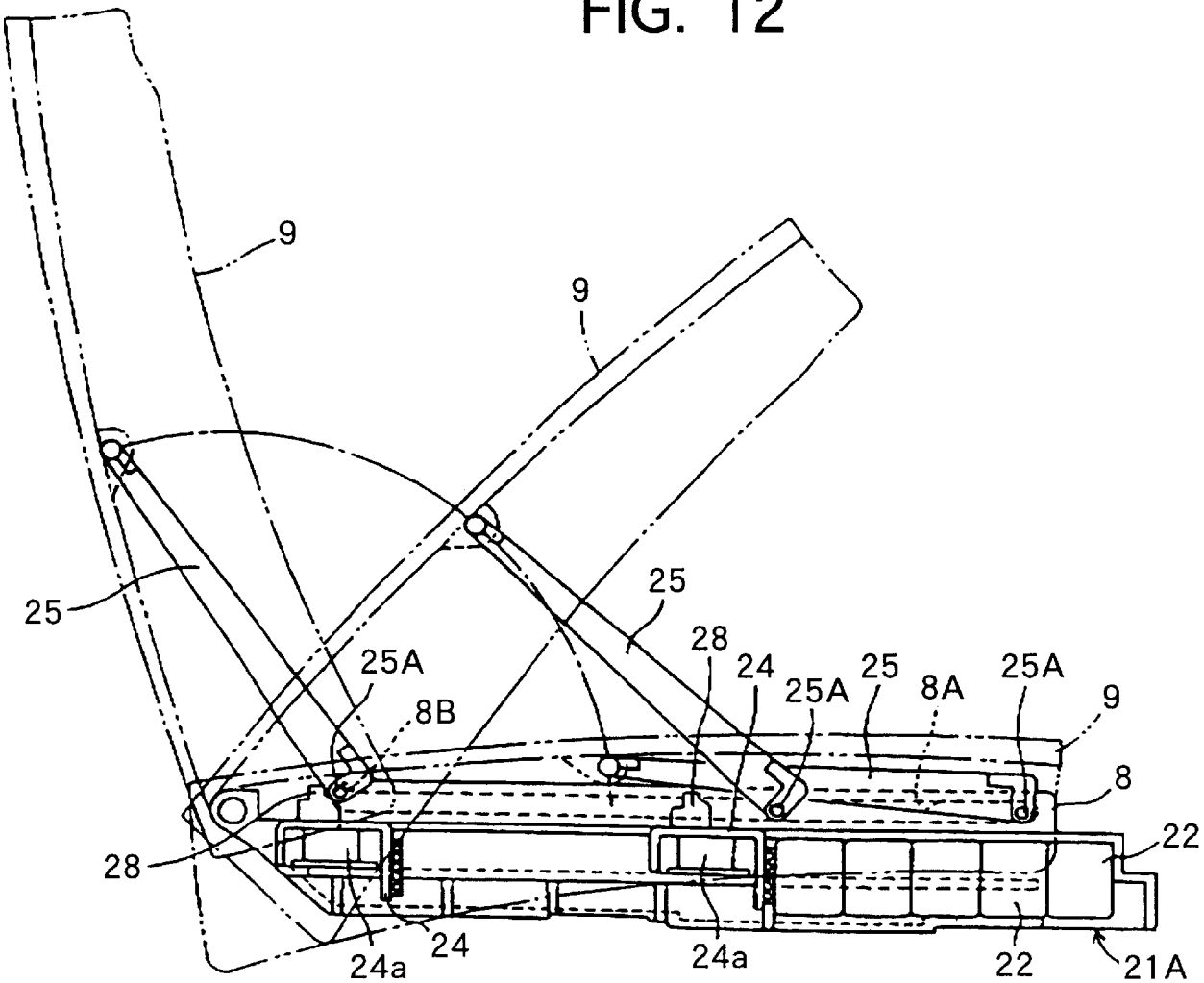
FIG. 12 is an explanatory view showing a cover member being pivoted.

As shown in FIG. 12, a projecting member 28 is provided on the upper surface of each pellet pressing member 24. A free end of a link member 25 contacts with each projecting member 28. The link member 25 preferably has a width slightly smaller than the distance between the both side wall surfaces of the ink case 8 so as to be in contact with the projecting members 28 of all the accommodating channel sections 21, as shown in FIG. 11. Insertion pegs 25A are formed at both sides of the free end of the link member 25. The insertion pegs 25A are movably engaged within guide slots 8A formed on both side walls of the ink case 8.

Each guide slot 8A is, as shown in FIG. 6(*b*), formed to extend linearly in a direction from the discharging section 21A to the insertion section 21C, and then connected to a stopper slot 8B bent upward at the insertion section 21C. The fixed end of the link member 25 is pivotally supported at approximately the center portion of the cover member 9. With this structure, the fixed end of the link member 25 is pulled up when the cover member 9 is pivoted open, and the free end moves along the guide slot 8A toward the insertion section 21C contacting with all of the projecting members 28 to thereby advance the projecting members 28 toward the insertion sections 21C along with the pellet pressing members 24. When the link member 25 is fully opened, the insertion pegs 25A are pulled up into the stopper slots 8B to fix the link member 25 in place so that the pellet pressing members 24 are supported while the cover member 9 is kept open.

With the above-described structure, the ink case 8 is used in a manner as described below.

When the cover member 9 is pivoted to the open position as shown in FIG. 12, the fixed end of the link member 25 is pulled up and the insertion peg 25A at the free end move along the guide concaves 8A toward the insertion sections 21C. When the insertion pegs 25A move toward the insertion sections 21C, the free end of the link member 25 contacts with all of the projecting members 28, and the pellet pressing members 24 move in the direction toward the insertion sections 21C, that is, in a direction opposite to the urging direction of the urging member 24*a*.

When the link member 25 is fully opened, the insertion pegs 25A are pulled up into the stopper slots 8B to fix the link member 25 so that the pellet pressing members 24 are fixed in the advanced position while the cover member 8 is open. Accordingly, the accommodating channel sections 21 are exposed and simultaneously the urging is released by the movement of the pellet pressing members 24, thereby completing preparation for placing the ink pellets 22 into the accommodating channel sections 21 by the single operation of opening the cover member 9.

When the cover member 9 is opened as described above, the ink holder 23 is placed into the insertion section 21C of one accommodating channel section 21 as shown in FIG. 6(*a*). When the ink holder 23 is pressed toward the insertion section 21C, the ink pellets 22 drop into the pellet supporting channel 21B. As shown in FIG. 8, the step portions 22*c* and 22*c* of each ink pellet 22 assuredly contact with the wall surfaces of the pellet supporting channel 21B to be supported thereby.

When the ink pellets 22 are thus placed into the pellet supporting channel 21B, the cover member 9 is pivoted so as to cover the ink case 8, as shown in FIG. 12, such that the free end of the link member 25 is advanced toward the discharging sections 21A. The pellet pressing members 24 supported by contact between the link member 25 and the projecting members 28 are moved toward the discharging sections 21A by the urging members 24*a*, whereby the ink pellets 22 in each of the accommodating channel sections 21 are moved respectively toward the discharging sections 21A, as shown in FIGS. 8 and 11. An ink pellet 22 that is located in the leading edge in each accommodating channel section 21 reaches the discharging section 21A, and is stopped and supported by the pellet supporting plate 68 as shown in FIG. 9. The upper and lower surfaces of the pellet 22, that is located on the discharging section 21A, are exposed. The ink pellet 22 thus placed on the discharging section 21A will be pressed downwardly as shown in FIG. 10 by the pellet dispensing mechanism 52 to thereby fall into a corresponding melting hopper 20 due to gravity.

Details of the ink case 8 are described in U.S. patent application Ser. No. 08/880,411 (attorney's docket number JAO30704), the disclosure of which is hereby incorporated by reference.

Figure 17:
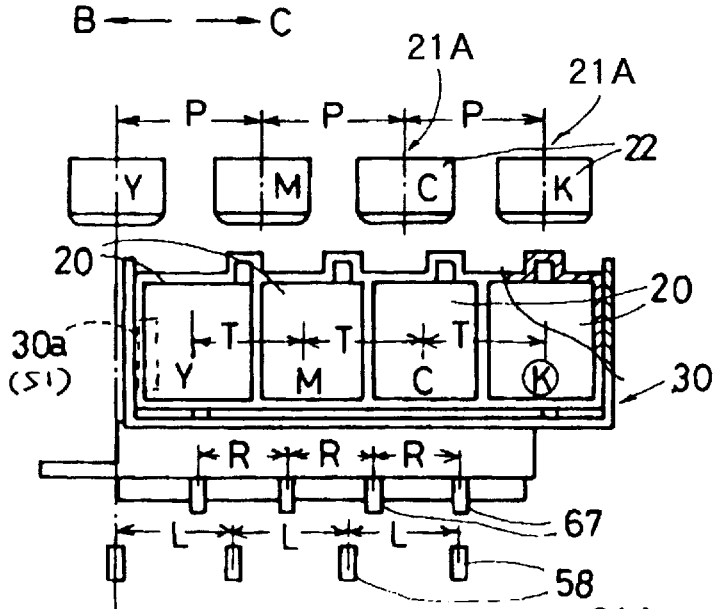
FIG. 17(*a*) is a plan view showing distances separating adjacent melting hoppers, adjacent ink pellet discharging sections, adjacent hook abutting protrusions, and adjacent hooks wherein the hook abutting protrusion for black (K) colored ink pellets is aligned with the corresponding hook.
Figure 17:
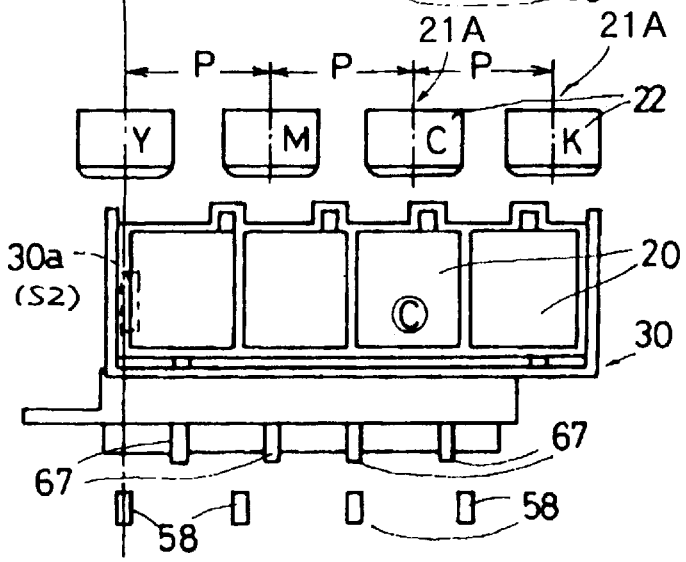
Figure 17:
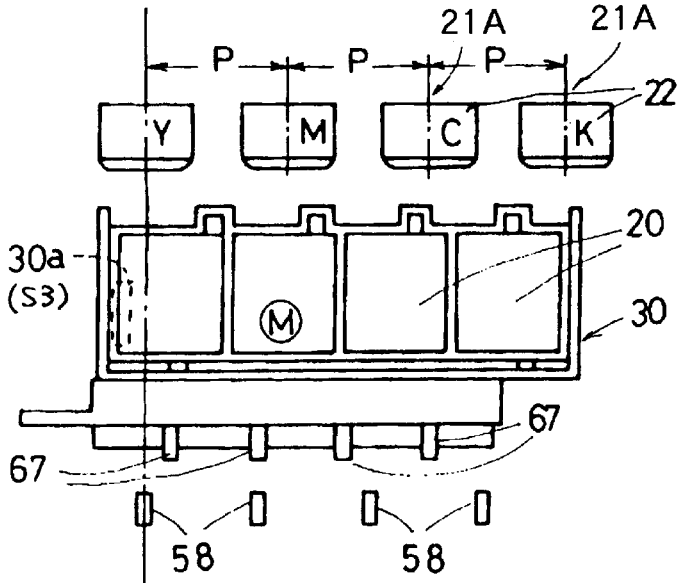
Figure 17:
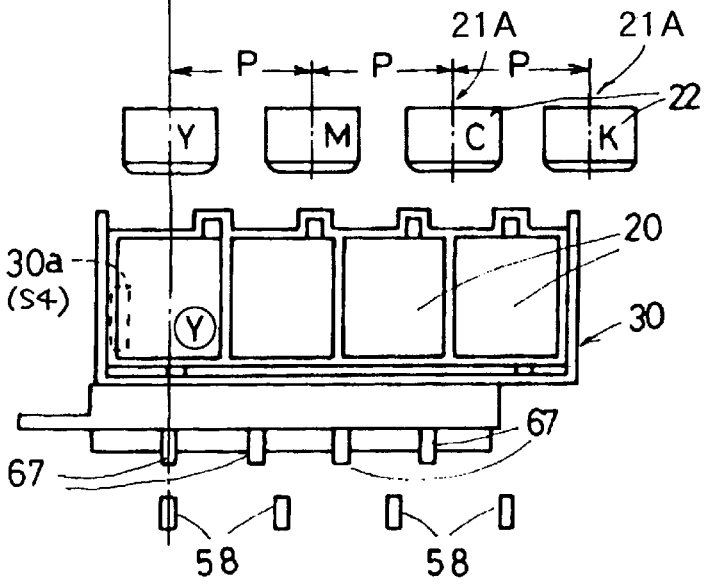

According to the present embodiment, as shown in FIG. 1, the ink case 8 is mounted in the ink supply portion 33 of the printer 1. The ink case 8 is mounted so that their discharging sections 21A are positioned above the movement pathway of the hoppers 20 on the carriage 30 as shown in FIG. 13. As shown in FIGS. 1 and 17(*a*), the ink case 8 is oriented so that the discharging sections 21A are arranged at the interval P along the main scanning direction indicated by arrows B and C.

In the present embodiment, the carriage 30 is designed so that the hoppers 20 for all the colors are arranged in the main scanning direction at an interval T as shown in FIG. 17(*a*). The interval T is set as different from the interval P. With this dimensional relationship, the discharging section 21A and the hopper 20 of only one desired color can be aligned together by merely controlling scanning movement of the carriage 30 to stop at a particular position. Further, the discharging sections 21A and hoppers 20 of other colors will not be in alignment so that the wrong colored ink will not erroneously drop in the hopper 20 desired to be replenished.

Next, the pellet dispensing mechanism 52 will be described below while referring to FIGS. 13–19.

Figure 16:
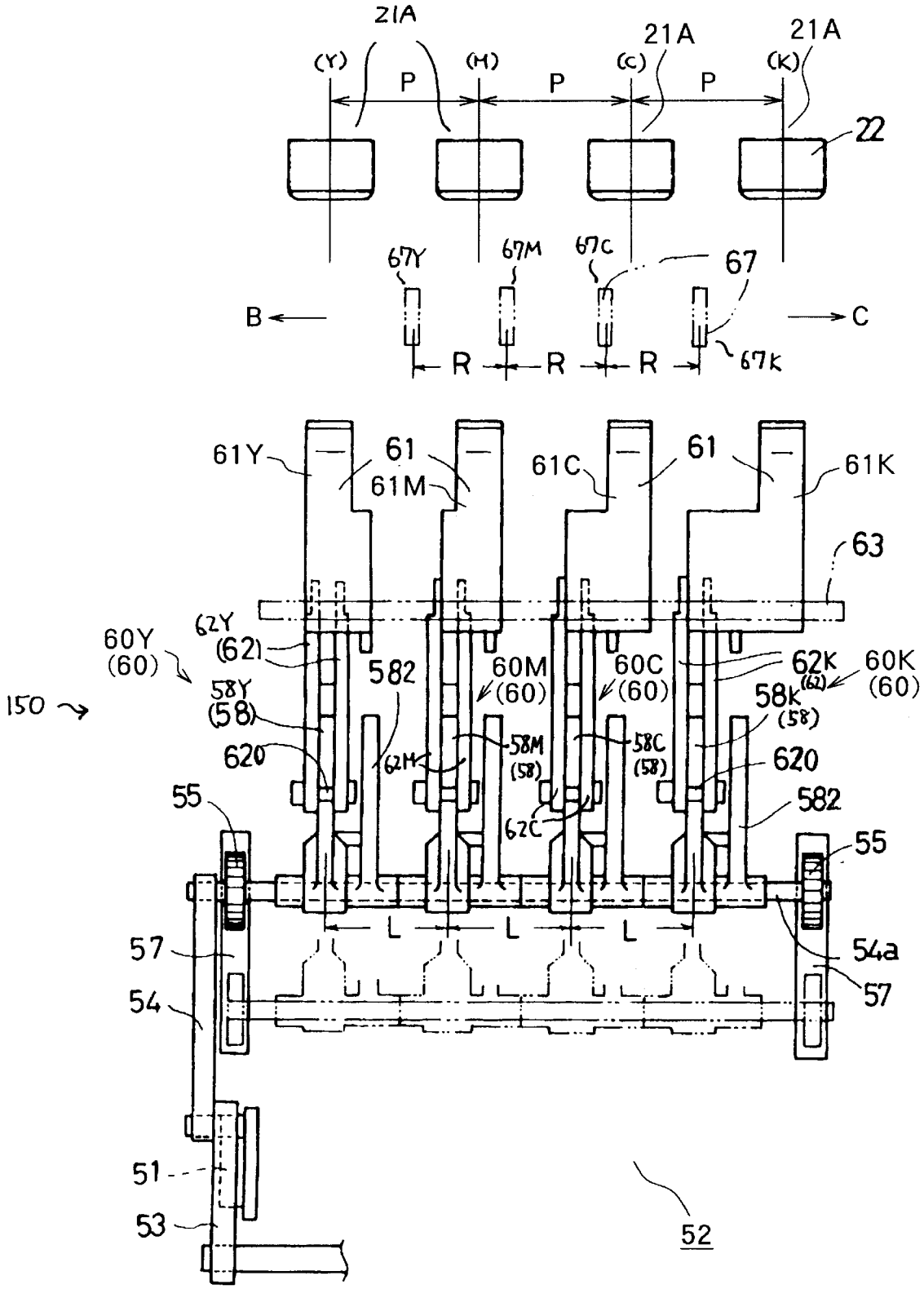
FIG. 16 is a front view showing the pellet dispensing mechanism.

FIG. 16 is a front view of the pellet dispensing mechanism 52. FIG. 13 is a cross-sectional view showing essential portions of the pellet dispensing mechanism 52 and the ink case 8. As shown in FIG. 13, the pellet dispensing mechanism 52 is disposed in front of the discharging sections 21A of the ink case 8.

The pellet dispensing mechanism 52 is for supplying an ink pellet 22 from a selected discharging section 21A of the ink case 8 to a corresponding melting hopper 20 on the carriage 30, which is being placed in the ink supply portion 33. As shown in FIG. 16, the pellet dispensing mechanism 52 includes four pressing bodies 61, which are disposed in confrontation with the four discharging sections 21A of the ink case 8, respectively. As shown in FIG. 13, the pellet dispensing mechanism 52 is driven by a cam 51. That is, when the cam 51 rotates from the posture (standby angular position) shown in FIG. 13 to that shown in FIG. 14 and then to that shown in FIG. 15, the pellet dispensing mechanism 52 is driven to operate a selected one of the four pressing bodies 61 to press an ink pellet 22 downward out of the corresponding discharging section 21A and into a corresponding melting hopper 20.

The pellet dispensing mechanism 52 will be described below in greater detail.

As shown in FIG. 16, the pellet dispensing mechanism 52 includes the four pressing bodies 61 (61*i*: i=Y, M, C, K) respectively positioned in correspondence with the four accommodating channel sections 21 of the four colors Y, M, C, and K. Each pressing body 61 is for downwardly pressing the upper surface of the ink pellet 22, that is located on the discharging section 21A of the corresponding channel section 21, in the manner shown in FIG. 10.

All the four pressing bodies 61 are provided as connectable to a single pivot lever 53 via a pivot control mechanism 150. The pivot lever 53 is constantly urged into the upward tilting posture shown in FIG. 13. The spiral shaped surface of the cam 51 is in contact with the pivot lever 53. The pivot lever 53 is forcibly pivoted up and down by the spiral surface of the cam 51 in accordance with the rotation of the cam 51.

As shown in FIG. 16, the pivot control mechanism 150 includes: a single connection arm 54 pivotally connected, at its lower end, to the free end of the pivot lever 53; a single lower shaft 54*a* pivotally supported on the upper end of the connection arm 54; and four pressing control portions 60 (60*i*: i=Y, M, C, K) each being pivotally connected to the shaft 54*a*. As shown in FIG. 13, the lower shaft 54*a* extends parallel to the guide shaft 31. The pivot control mechanism 150 is sandwiched between a main frame 56 and a cover frame 59, which are fixedly mounted to a frame (not shown)

of the printer 1. The main frame 56 is oriented to confront the guide shaft 31.

Figure 18:
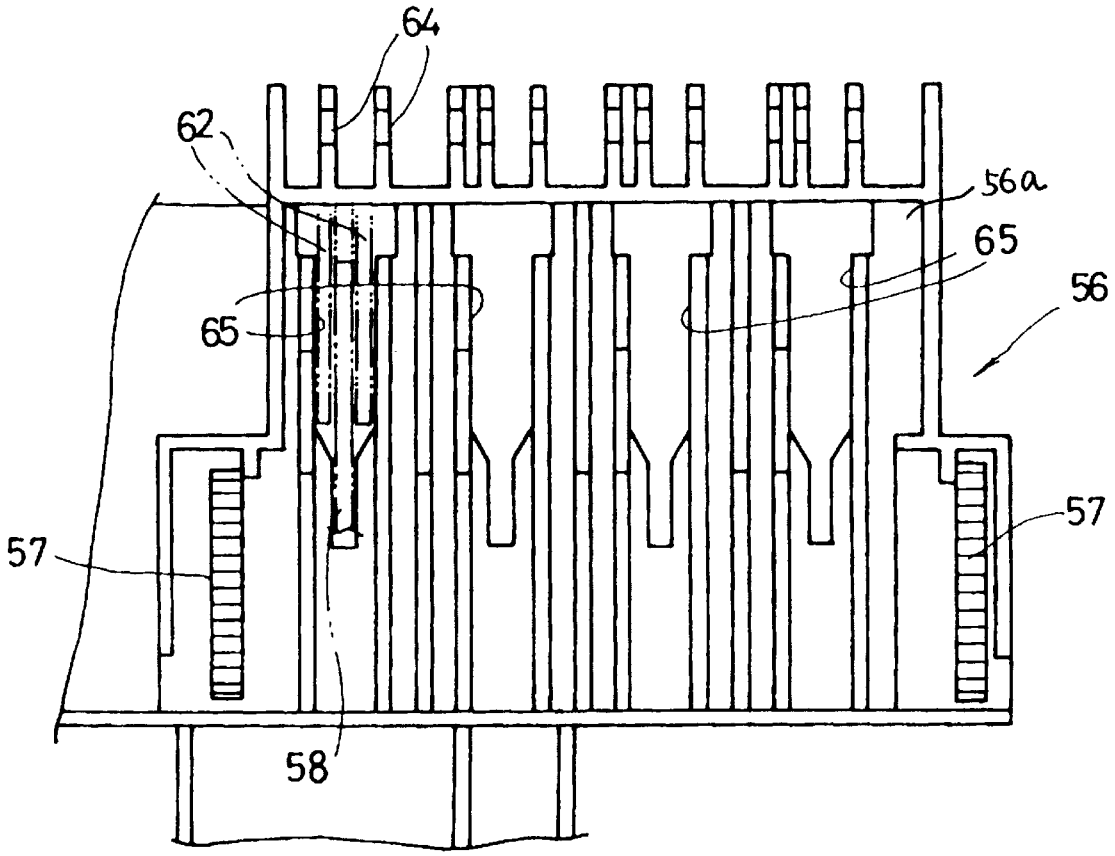
FIG. 18 is a front view showing a main frame of the pellet dispensing mechanism.

As shown in FIGS. 13, 16, and 18, the four pressing bodies 61 are pivotally and detachably supported to the main frame 56 via an upper shaft 63. That is, the main frame 56 is formed, at its upper edge, with a plurality of upper shaft support holes 64. The upper shaft 63 is inserted through and rotatably supported by the upper shaft support holes 64. The upper shaft 63 extends parallel to the guide shaft 31. Lower tip ends of the pressing bodies 61 are pivotably supported by the upper shaft 63.

Figure 19:
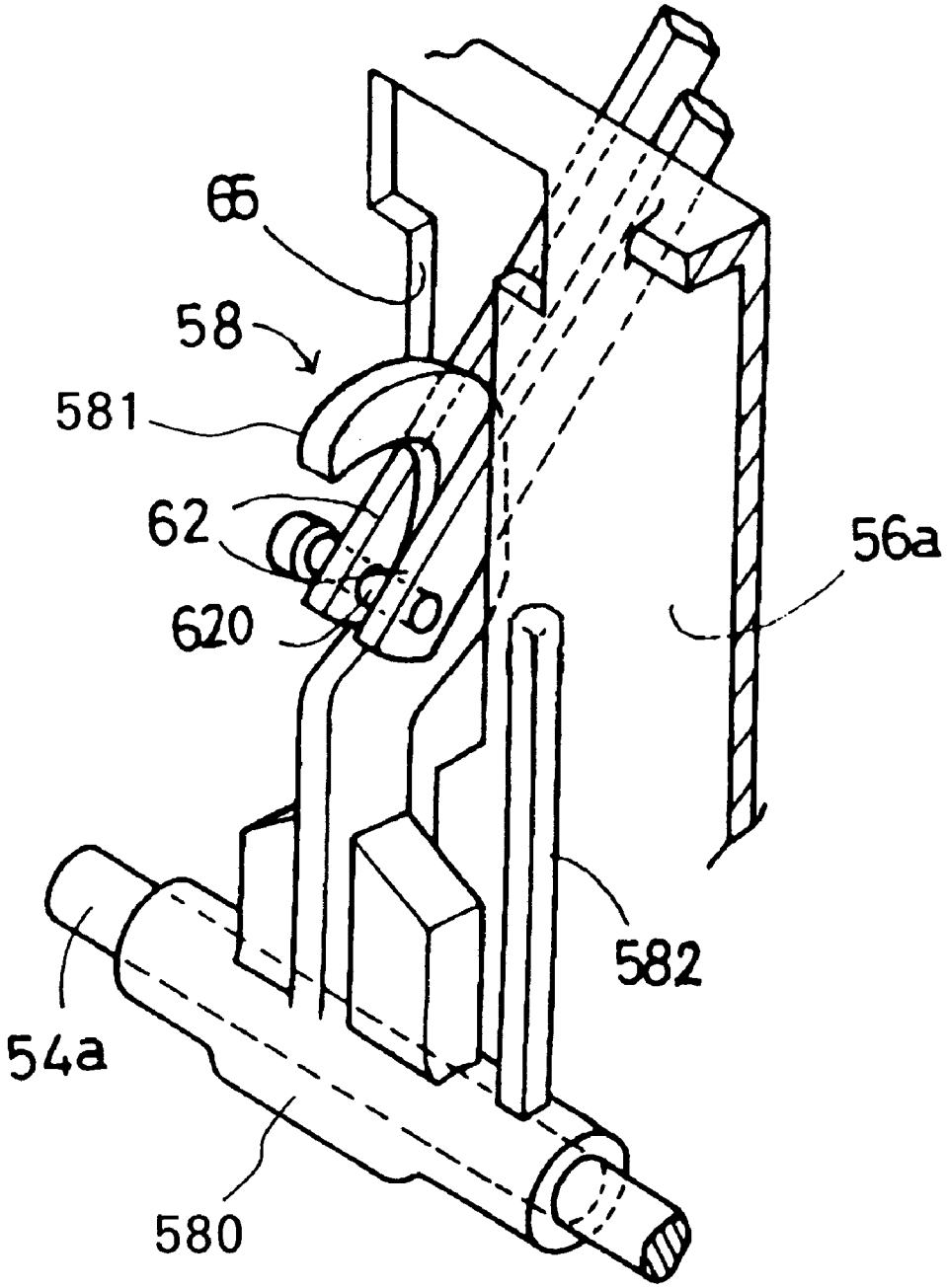
FIG. 19 is a perspective view showing a hook and a link of the pellet dispensing mechanism.

Each pressing control portion 60*i* (i=Y, M, C, K) includes a link 62 (62*i* (i=Y, M, C, K)), an upper end of which is pivotally connected to a lower tip of the corresponding pressing body 61*i* (i=Y, M, C, K). As shown in FIG. 19, the link 62 is of a two prong shape and has a pin 620 at its lower free end. Each pressing control portion 60*i* (i=Y, M, C, K) further includes a hook 58 (58*i* (i=Y, M, C, K)). In each pressing control portion 60*i*, the hook 58 is disposed below the link 62 as engagable with the pin 620. The hook 58 is made from a base portion 580 and a hook portion 581. The hook portion 581 is configured in the shape of a hook so as to be engagable with the pin 620 at its free end. A sliding body 582 is fixedly attached to the base portion 580 so that the sliding body 582 and the hook portion 581 protrude in the same direction from the base portion 580.

As shown in FIGS. 18 and 19, the main frame 56 is made from a flat plate 56*a*. The flat plate 56*a* is formed with four guide through-holes 65. As shown in FIGS. 13 and 19, the link 62 and the hook 58 of each pressing control portion 60*i* (i=Y, M, C, K) partially protrude through a corresponding guide hole 65 from the main frame 56. As shown in FIG. 18, the main frame 56 is formed with a pair of rack portions 57 and 57. The rack portions 57 and 57 are formed at the inner surface of the main frame 56 at its both side edges. The rack portions 57 and 57 are provided to extend vertically.

As shown in FIG. 16, the lower shaft 54*a* extends in the widthwise direction of the frames 56 and 59, and is pivotably supported on the connection arm 54. As shown in FIG. 19, the lower shaft 54*a* is pivotably inserted into the base portion 580 of the hook 58 in each pressing operation portion 60*i*.

As shown in FIG. 13, an urging plate spring 66 is attached to the inner side of the cover frame 59. The urging plate spring 66 is for urging the hook 58 of each pressing operation portion 60*i* in a direction toward the carriage 30. As shown in FIG. 19, the sliding body 582 is provided protruding upward from the base portion 580 of the hook 58. Because the urging force is applied to the hook 58, the sliding body 582 is urged against the flat plate 56*a* of the main frame 56. Accordingly, the sliding body 582 is normally in such a posture that slides along the inner surface of the flat plate 56*a*. Therefore, the hook 58 is normally maintained in its substantially upright posture.

As shown in FIG. 16, a pair of pinion gears 55 and 55 are rotatably provided to both ends of the lower shaft 54*a*. The pinion gears 55 and 55 are meshingly in engagement with the rack portions 57 and 57 on the main frame 56. By moving the lower shaft 54*a* upward and downward between the main frame 56 and the cover frame 59, the hooks 58 in all the four pressing control portions 60 shown in FIG. 16 can be moved vertically at the same time.

As shown in FIG. 4 and 17(*a*), the four ink melting hoppers 20 are arranged on the carriage 30 in a direction parallel to the guide shaft 31. As described above, the four hook abutting protrusions 67 are fixedly provided at the front side of the carriage 30 adjacent to the melting hoppers 20. The four hook abutting protrusions 67 are provided in correspondence with the four colors, respectively, and are arranged also parallel to the guide shaft 31. Each hook abutting protrusion 67*i* (i=Y, M, C, K) is provided for abutting against a hook 58*i* (i=Y, M, C, K) of a corresponding pressing operation portion 60*i* (i=Y, M, C, K), thereby moving the corresponding hook 58 forwardly in a direction toward the cover frame 59.

According to the present embodiment, the hook abutting protrusions 67 are arranged along the carriage 30 so that, when a particular hook abutting protrusion 67*i* is in contact with a hook 58*i* of a corresponding pressing operation portion 60*i*, the other remaining three hook abutting protrusions 67 fail to contact with the hooks 58 of the other remaining three pressing operation portions 60.

More specifically, the pivot control mechanism 150 is designed as shown in FIG. 16 so that the four hooks 58 are arranged along the lower shaft 54*a* as separated from one another by a distance L. The four hook abutting protrusions 67 on the carriage 30 are arranged parallel to the guide shaft 31 as separated from one another by another distance R, which is different from the distance L. This configuration enables a desired hook abutting protrusion 67*i* only to be positioned behind its corresponding hook 58*i* by driving the carriage 30 to stop at a selected position in the main scanning direction along the guide shaft 31. Once thus positioned, only a desired one of the hook abutting protrusions 67 will slide against the rear surface of its corresponding hook 58 when the hook 58 moves vertically downwardly as described above.

With the above-described structure, the pellet dispensing mechanism 52 operates as described below.

Figure 14:
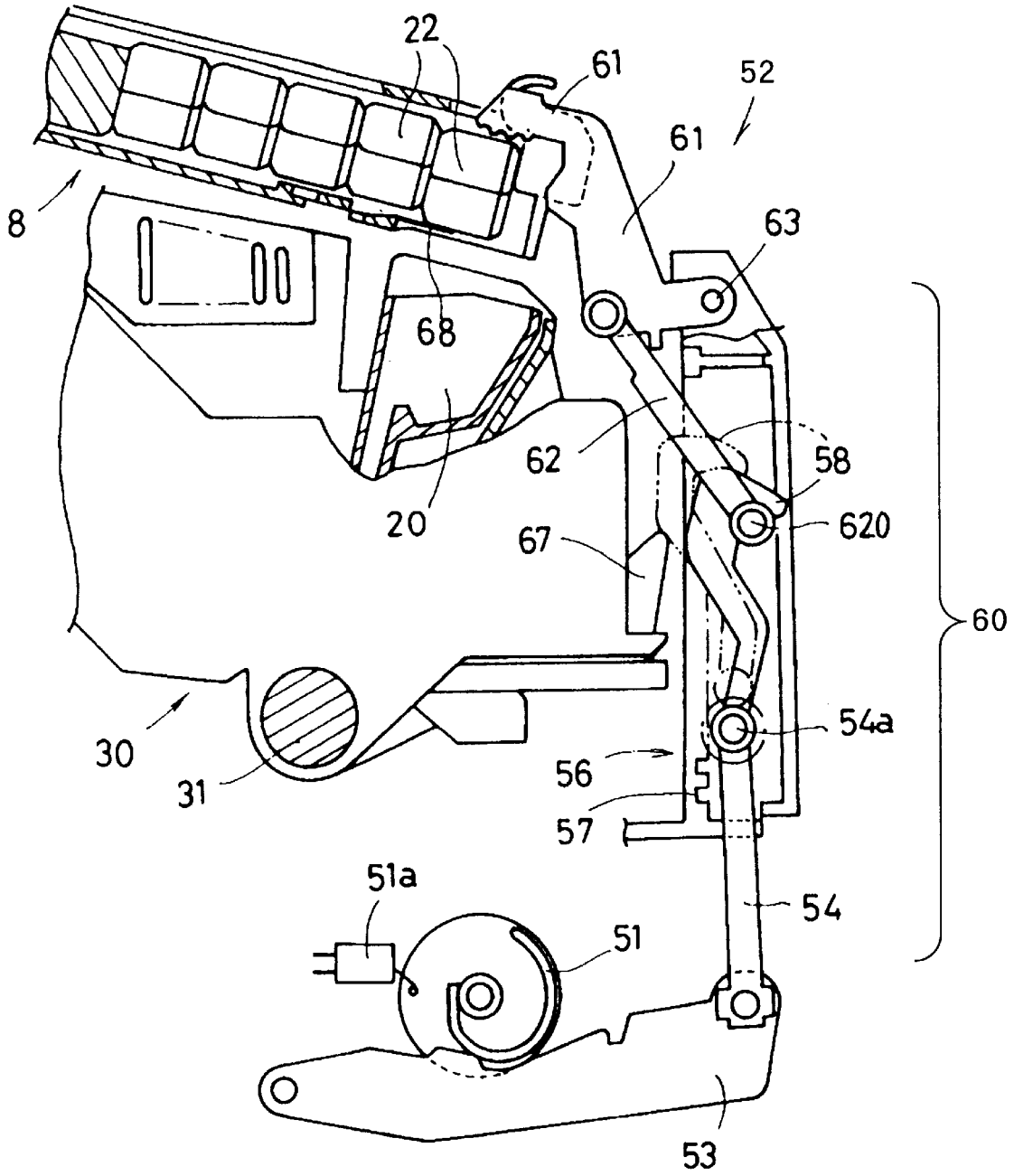
FIG. 14 is a side view in partial cross section showing changes a hook abutting protrusion produces in the posture of a corresponding hook.
Figure 15:
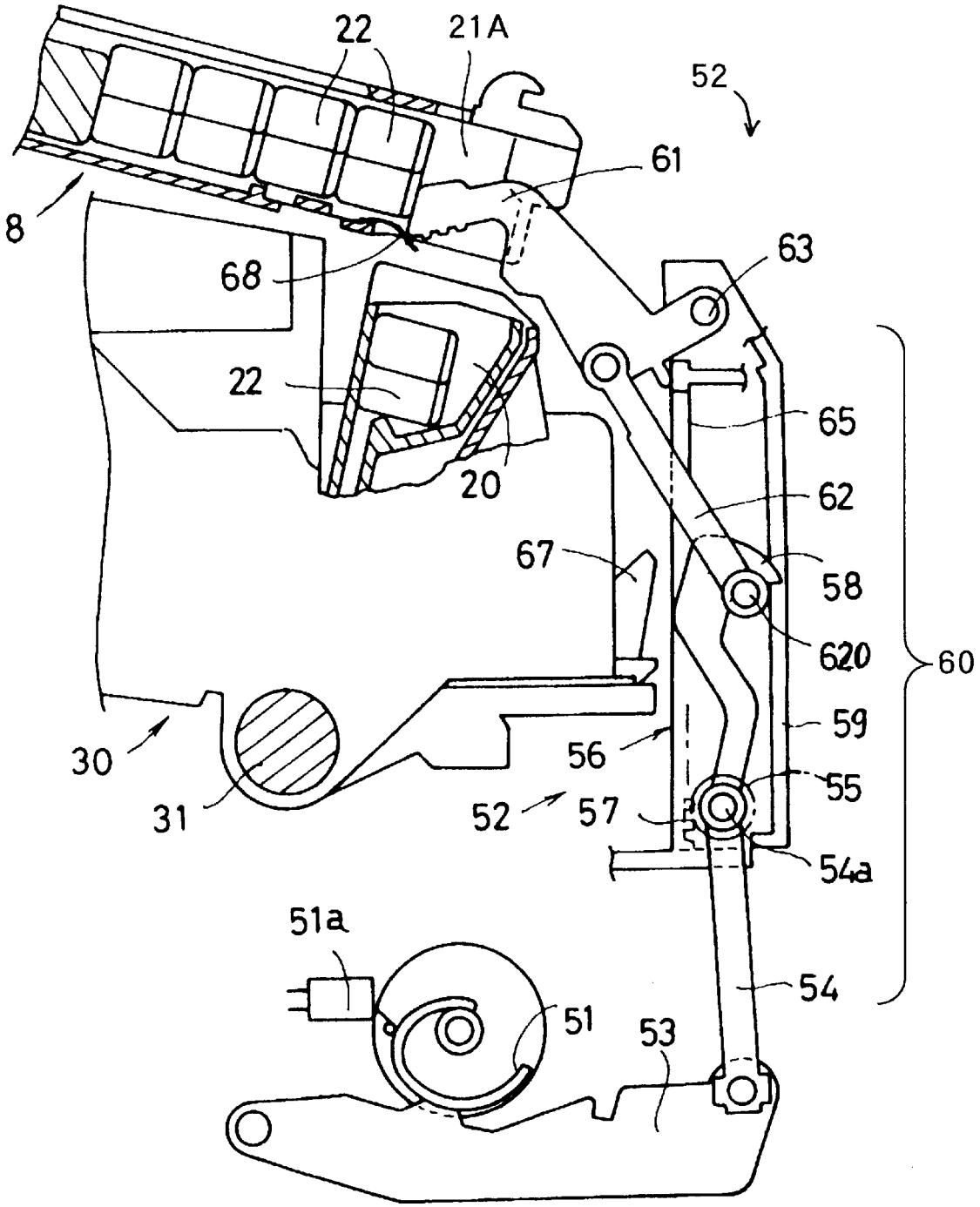
FIG. 15 is a side view showing a pressing body pressing a corresponding ink pellet downward.

When the cam 51 starts rotating from its standby angular position shown in FIG. 13 via another angular position shown in FIG. 14 to a final angular position shown in FIG. 15, the pivot lever 53 pivots vertically downwardly. As a result, the connection arm 54 and the lower shaft 54*a* move downwardly while the pinion gears 55 rotatingly move along the rack portions 57. All the hooks 58 on the lower shaft 54*a* also move downwardly.

Only one selected hook 58 contacts with the corresponding hook abutting protrusion 67. The hook 58 slides against the hook abutting protrusion 67, and then, as indicated by a two-dot chain line in FIGS. 14 and 15, the hook 58 is pivoted in the clockwise direction against the urging force of the urging plate spring 66 and so moves downward. The hook 58 then engages with the pin 620 at the lower tip of the link 62, and pulls the link 62 downwardly. The corresponding pressing body 61 is pivoted around the shaft 63 in association with the downward movement of the hook 58. As a result, as shown in FIG. 15, the ink pellet 22, supported by the resilient support rib 68 in the corresponding discharging portion 21A, is pressed downwardly toward the corresponding melting hopper 20.

On the other hand, other remaining hooks 58, that are not abutted by their corresponding hook abutting protrusions 67, are lowered while being maintaining in their substantially upright posture with their sliding bodies 582 sliding against the flat surface 56*a* of the main frame 58. Therefore, the pressing bodies 61 corresponding to the nonselected hooks 58 are not pivoted into the posture shown in FIG. 15 so that ink pellets 22 are not discharged from the corresponding discharging sections 21A.

Thus, the pellet dispensing mechanism 52 can discharge an ink pellet 22 only from one accommodating channel section 21 corresponding to one hopper 20, to which ink is desired to be supplied.

For example, when desiring to drop a black (K) ink pellet 22 only into a melting hopper 20 for black (K) ink, the carriage 30 should be stopped in a position as shown in FIG. 17(*a*) in the main scanning direction indicated by the arrows B and C. The carriage 30 is stopped with its rightward-most hook abutting protrusion 67 (67K) being in positional alignment with the rightward-most hook 58 (58K) on the pellet dispensing mechanism 52.

On the other hand, when desiring to drop a cyan (C) ink pellet 22 into another melting hopper 20 for cyan (C) ink, the carriage 30 should be stopped in another position as shown in FIG. 17(*b*) in the main scanning direction. The carriage 30 is stopped with its hook abutting protrusion 67 (67C) second from the right being in positional alignment with the hook 58 (58C) second from the right.

On the other hand, when desiring to drop a magenta (M) ink pellet 22 into still another melting hopper 20 for magenta (M) ink, the carriage 30 should be stopped in still another position as shown in FIG. 17(*c*) in the main scanning direction. The carriage 30 is stopped with its hook abutting protrusion 67 (67M) third from the right being in positional alignment with the hook 58 (58M) third from the right.

Similarly, when desiring to drop a yellow (Y) ink pellet 22 into still another melting hopper 20 for yellow (Y) ink, the carriage 30 should be stopped in still another position shown in FIG. 17(*d*) in the main scanning direction. The carriage 30 is stopped with its leftward-most hook abutting protrusion 67 (67Y) in positional alignment with the leftward-most hook 58 (58Y).

It is noted that the distance P is desirably set to be greater than the distance L between the hooks 58 on the pellet dispensing mechanism 52. Further, the distance L is desirably greater than the distance R between the hook abutting protrusions 67.

It is desirable that the distance P be the greatest dimension among the distances L, P, and R. That is, the distance P is desirably greater than distance L and distance R, so that large ink pellets 22, that is, large in width, can fit in the discharging sections 21B. More preferably, the distances P, L, and R satisfy the following inequality: P>L>R.

In this example, the distance T, set to be different from the distance P, is set to be substantially the same distance as the distance L between the hooks 58. Thus, the distance T satisfies the following inequality: P>T>R. Accordingly, in this example, the pressing bodies 61Y, 61M, 61C, and 61K are formed differently from one another as shown in FIG. 16 so as to shift the front tip of each pressing body 61 in the main scanning direction to locate the front tip of each pressing body 61 at a position required to press against the upper surface of the corresponding ink pellet 22 into a corresponding hopper 20.

More specifically, the distances P, T, L, and R are determined according to the present embodiment in a manner described below.

First, the size of each pellet accommodating channel 21 is determined in accordance with the size of the ink pellets 22. Then, the four pellet accommodating channels 21 are arranged so that their pellet discharging sections 21A are arranged at the interval P. Then, the four pressing bodies 61 are positioned so that at least their tip ends confront the four pellet discharging sections 21A, respectively, as shown in FIG. 16. Thus, the positions of at least the tip ends of the four pressing bodies 61 are determined based on the interval P.

Next, the four hoppers 20 are arranged on the carriage 30 at the interval T as different from the interval P. The intervals L and R are then determined in correspondence with the intervals P and T so that ink pellets can be selectively supplied to the hoppers 20 through merely controlling the stopping position of the carriage 30.

It is noted that if T is selected as equal to P, when the carriage 30 is stopped to locate one selected hopper 20 at its ink supply position, all the other remaining hoppers 20 will also be located at their ink supply positions. Accordingly, when the cam 51 is driven, ink supply operation will be attained onto all the hoppers 20. It therefore becomes impossible to supply ink pellets only to the one selected hopper 20 through merely controlling the stopping position of the carriage 30.

Contrarily, according to the present embodiment, T is selected as different from P. Accordingly, when the carriage 30 is stopped to locate one selected hopper 20 at its ink supply position, any of the other remaining hoppers 20 will not be located at their ink supply positions. Accordingly, it becomes possible to supply ink pellets only to the one selected hopper 20 through merely controlling the stopping position of the carriage 30.

P and T are preferably selected as satisfying an inequality of T<P. When T<P, L and R are determined to satisfy another inequality of R<L. Because T is small, the carriage 30 can be made compact. Because P is large, the ink case 8 and the pressing bodies 61 can be produced easily. All the four colors can be supplied from the four pellet discharging sections 21A to the corresponding hoppers 20 through merely moving the carriage 30 a distance of (3P–3T).

As described above, the pellet discharging mechanism 52 is driven, by the rotational movement of the cam 51, to move all the four hooks 58 downwardly. In order to supply ink of a desire color, the position of the carriage 30 is controlled along the guide shaft 31 so that a corresponding hook abutting protrusion 67 will abut against a corresponding hook 58, thereby allowing only a corresponding pushing body 61 to push down an ink pellet 22 of the desired color.

The cam 51 is driven by the motor 38 as described below.

As shown in FIG. 4, the reversibly rotatable drive motor 38 is provided for driving the single rotational shaft 39 via the power transmission unit (timing belt) 40. The discharge rollers 18 are mounted on the rotational shaft 39. The discharge rollers 18 are applied with rotational power from the motor 38 to perform its sheet discharging operation in the printing portion 32.

A pair of gears 41 and 70 are also mounted on the rotational shaft 39. The gear 41 is for transmitting power from the motor 38 to a first power transmission portion 140. The gear 70 is for transmitting power from the motor 38 to a second power transmission portion 134. The first power transmission portion 140 is for transmitting power from the motor 38 to the ink supply portion 33. The second power transmission portion 134 is for transmitting power from the motor 38 to the maintenance operation portion 34. The first power transmission portion 140 is located in the ink supply portion 33. The second power transmission portion 134 is provided in the maintenance operation portion 34.

The first power transmission portion 140 includes an ink supply clutch 35 for selectively transmitting power from the motor 38 to the ink supply portion 33 in association with leftward and rightward movement of the carriage 30 along the guide shaft 31. When the clutch 35 is in its ON condition, power from the drive motor 38 is transmitted, via the cam 51, to the pellet dispensing mechanism 52. When the clutch 35 is in its OFF condition, on the other hand, power from the drive motor 38 is not transmitted to the pellet dispensing mechanism 52. The clutch 35 is turned ON and OFF in accordance with movement of the carriage 30 toward and away from the ink supply portion 33.

The second power transmission portion 134 includes another clutch 36 for selectively transmitting power from the motor 38 to the maintenance operation portion 34 in association with leftward and rightward movement of the carriage 30 along the guide shaft 31. When the clutch 36 is in its ON condition, power from the drive motor 38 is transmitted to the gear 76*c* of the maintenance operation mechanism provided in the maintenance operation portion 34. When the clutch 36 is in its OFF condition, power from the drive motor 38 is not transmitted to the gear 76*c*. The clutch 36 is turned ON and OFF in accordance with movement of the carriage 30 toward and away from the maintenance operation portion 34.

The power transmission portion 140 will be described below while referring to FIGS. 4 and 20(*a*)–22(*b*). The power transmission portion 140 includes a gear train 42 for transmitting rotational force from the drive shaft 39 to the upstream side of the ink supply clutch 35. The gear train 42 includes a first gear 42*b* in meshing engagement with the gear 41; and a second gear 42*a* in meshing engagement with the first gear 42*b*.

Figure 20:
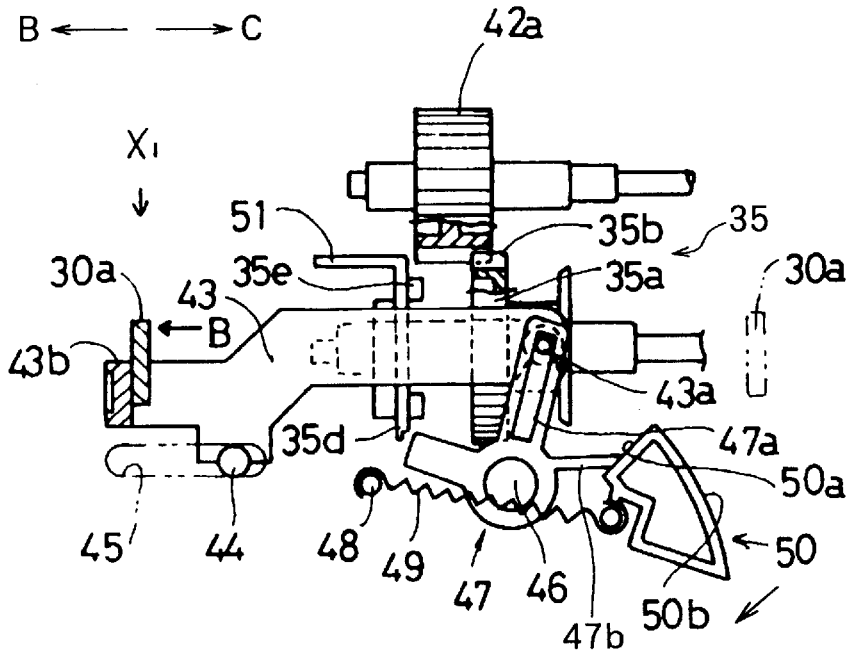
FIG. 20(*a*) is a plan view showing a clutch in an OFF condition.
Figure 20:
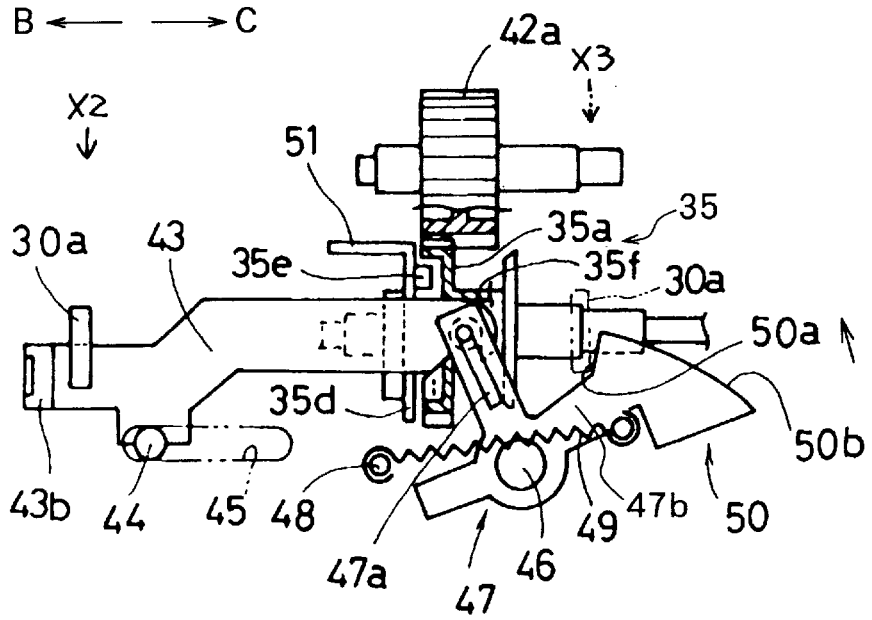
Figure 21:
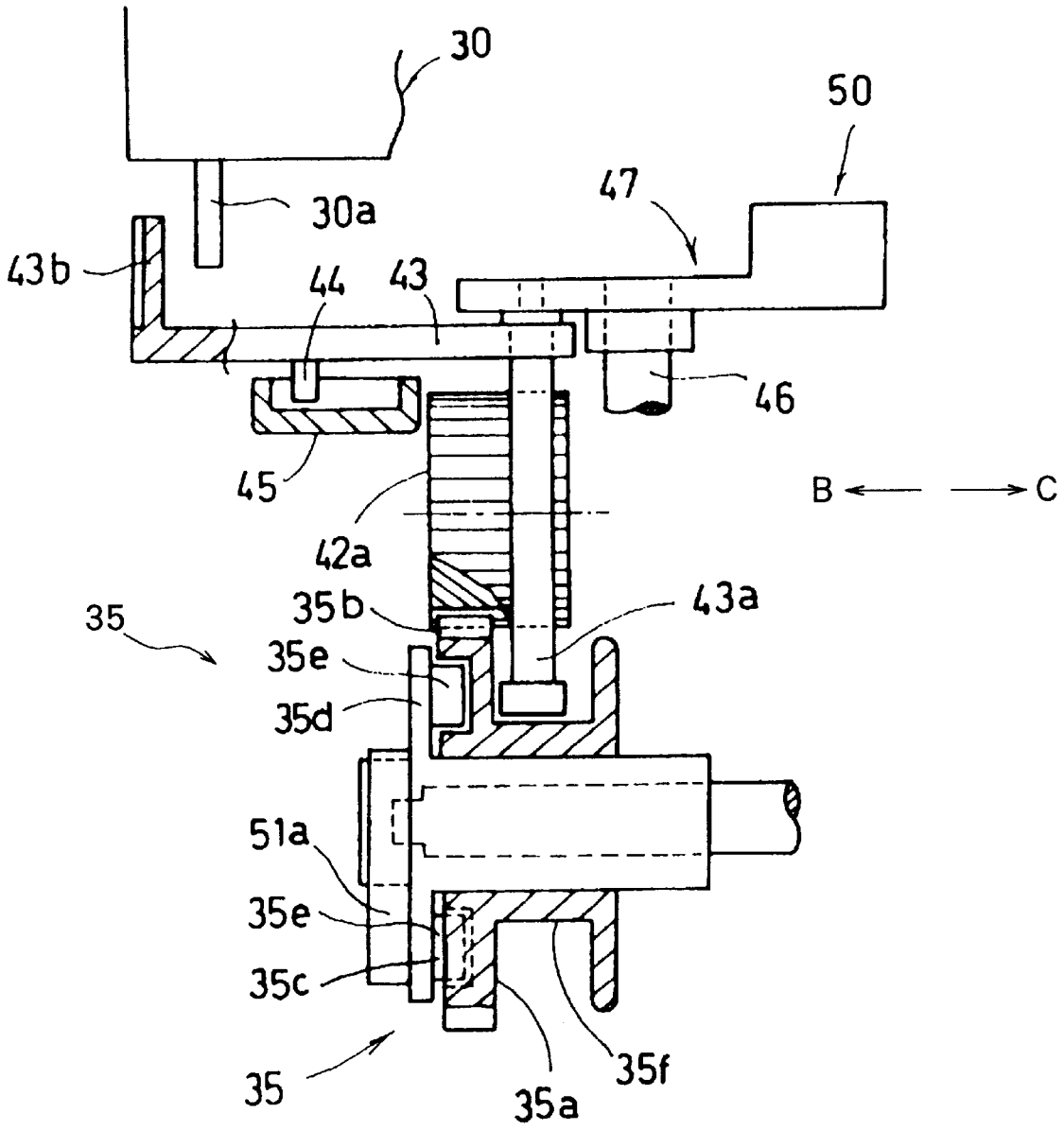
FIG. 21 is a front view showing details of the clutch.

As shown in FIGS. 20(*a*)–21, the ink supply clutch 35 includes: a drive clutch body 35*a* and a follower clutch body 35*d*. The drive clutch body 35*a* is formed with a gear 35*b*. As shown in FIG. 21, the drive clutch body 35*a* is provided with a shift ring portion 35*f* for receiving a lower tip end of a shift lever 43*a* as described later. In accordance with movement of the shift lever 43*a* in the main scanning direction indicated by the arrows B and C, the drive clutch body 35*a* can move in the main scanning direction with its gear 35*b* being continuously engaged with the gear 42*a*. The gear 35*b* is thus always engaged with the gear 42*a*.

The drive clutch body 35*a* is formed with several engagement recesses or holes 35*c*, and the follower clutch body 35*d* is formed with several engagement pawls 35*e*. The engagement recesses 35*c* and the engagement pawls 35*e* are designed so that the engagement pawls 35*e* can be engaged with the engagement recesses 35*c* when the drive clutch body 35*a* moves in the direction B to finally contact the follower clutch body 35*d*. It is noted that the engagement recesses 35*c* may be formed in pawl shape engageable with the engagement pawls 35*e*.

The cam 51 is formed at the surface of the follower clutch body 35*d* opposite to the surface where the several engagement pawls 35*e* are formed. The cam 51 is formed in the spiral shape as shown in FIG. 13.

As shown in FIG. 21, the shift lever 43 and a toggle lever 47 are disposed above the clutch 35.

The toggle lever 47 is pivotably supported on its shaft 46. As shown in FIG. 20(*a*), the toggle lever 47 includes a first arm portion 47*a* and a second arm portion 47*b* which extend from the shaft 46 in different directions. The first arm portion 47*a* is pivotally connected to the shift lever 43 via the engagement shaft 43*a*. The lower tip end of the engagement shaft 43*a* is received by the shift ring portion 35*f* of the drive clutch body 35*a*. An urging spring (dead point spring) 49 is provided between the second arm portion 47*b* and an engagement pin 48, which is provided protruding from the frame (not shown) of the printer 1.

The shift lever 43 is provided with an abutment rib 43*b*. The abutment rib 43*b* protrudes upwardly from the left end of the shift lever 43. As shown in FIGS. 20(*a*) and 21, the abutment rib 43*b* protrudes into a leftward and rightward movement pathway of the pressing rib 30*a*, which protrudes downwardly from the carriage 30. Accordingly, when the carriage 30 moves in the direction B along the guide shaft 31, the pressing rib 30*a* can abut against the abutment rib 43*b*. The shift lever 43 is also provided with a pin 44 which protrudes downwardly from the shift lever 43. A tip end of the pin 44 is received in a guide groove 45 which is formed on the frame (not shown) of the printer 1. The guide groove 45 extends in the main scanning direction indicated by the arrows B and C. Although not shown in the drawings, another guide structure is provided for guiding the engagement shaft 43*a* to be movable in the same direction as the guide groove 45.

With the above-described structure, the shift lever 43 is movable with the pin 44 being received in the guide groove 45 and the engagement shaft 43*a* being guided by the guide structure (not shown). Thus, the shift lever 43 can move in parallel with the carriage 30 in the main direction indicated by the arrows B and C. When the shift lever 43 moves in the direction B following the guide groove 45, the toggle lever 47 pivots counterclockwise around the shaft 46 in FIG. 20(*a*). As a result, the engagement shaft 43*a* moves in the direction B, whereby the drive clutch body 35*a* moves in the direction B to be brought into contact with the follower clutch body 35*d* as shown in FIG. 20(*b*). As a result, the clutch 35 turns ON in association with the leftward movement of the shift lever 43. When the shift lever 43 then moves back in the direction C following the guide groove 45 from the state of FIG. 20(*b*), the toggle lever 47 pivots clockwise around the shaft 46 in FIG. 20(*b*). As a result, the engagement shaft 43*a* moves in the direction C, whereby the drive clutch body 35*a* moves in the direction C to separate from the follower clutch body 35*d* as shown in FIG. 20(*a*). As a result, the clutch 35 turns OFF in association with the rightward movement of the shift lever 43.

Thus, rotational force can be selectively transmitted from the gear 41 to the cam 51 of the follower clutch body 35*b* via the gear train 42 and the drive clutch body 35*a*.

The urging spring (dead point spring) 49 serves to maintain the toggle lever 47 in either its first pivotal position (power interrupt position) shown in FIG. 20(*a*) and its second pivotal position (power transmission position) shown in FIG. 20(*b*) in accordance with the movement of the shift lever 43 in the directions B and C.

As shown in FIG. 20(*a*), before the pressing rib 30*a* of the carriage 30 presses against the abutment rib 43*b*, the first arm 47*a* of the toggle lever 47 is in its first pivotal position. At this time, the urging spring 49 is positioned opposite the arm 47*a* with respect to the axial center of the shaft 46. Therefore, the urging spring 49 pulls the second arm 47*b* away from the arm 47*a*. In other words, the urging spring 49 applies an urging force to rotate the toggle lever 47 clockwise. Because rightward movement of the shift lever 43 and the engagement shaft 43*a* are restricted by the guide groove 45 and the guide structure (not shown), the toggle lever 47 may not rotate from the first pivotal position of FIG. 20(*a*) further in the clockwise direction. Accordingly, the toggle lever 47 is maintained in the first pivotal position of FIG. 20(*a*). When the toggle lever 47 is thus in the first pivotal position, the engagement shaft 43*a* locates the drive clutch body 35*a* separated from the follower clutch body 35*d*. Accordingly, the engagement recesses 35*c* on the drive clutch body 35*a* and the engagement pawls 35*e* on the follower clutch body 35*d* can be maintained separate from one another so that transmission of drive force is reliably interrupted.

When the carriage 30 moves in the leftward direction B from its original position, as indicated by a two-dot chain line in FIG. 20(*a*), the pressing rib 30*a* reaches the abutment rib 43*b* at a first predetermined position X1 as indicated by a solid line in FIG. 20(*a*). The carriage 30 can further move in the leftward direction B by a predetermined amount of length while the pressing rib 30*a* pressing against the abutment rib 43*b*. The predetermined amount of length corresponds to the length of the guide groove 45 in the main scanning direction. As a result, the carriage 30 reaches a second predetermined position X2 shown in FIG. 20(*b*). While the carriage 30 moves from the first position X1 to the second position X2, the abutment rib 43*b* moves the predetermined distance, and the toggle lever 47 pivots in the counterclockwise direction to reach the second pivotal position shown in FIG. 20(*b*).

In the second pivotal position of FIG. 20(*b*), the urging spring 49 is positioned on the same side of the first arm portion 47*a* with respect to the axial center of the shaft 46. Accordingly, the urging spring 49 pulls the second arm 47*b* toward the first arm 47*a*. In other words, the urging spring 49 applies an urging force to rotate the toggle lever 47 counterclockwise. As a result, the engagement shaft 43*a* moves the drive clutch body 35*a* toward the follower clutch body 35*d*. The engagement recesses 35*c* on the drive clutch body 35*a* are brought into engagement with the engagement pawls 35*e* of the follower clutch body 35*d*, whereby transmission of power is switched ON. The urging spring 49, presently located on the same side of the first arm 47*a* with respect to the axial center of the shaft 46, continuously applies the urging force to rotate the toggle counterclockwise. The engagement between the engagement recesses 35*c* and the engagement pawls 35*e* is therefore reliably maintained.

Thus, the toggle lever 47 serves to maintain the ink supply clutch 35 in the predetermined postures of FIGS. 20(*a*) and 20(*b*) to maintain the ON and OFF conditions of the ink supply clutch 35.

As shown in FIGS. 20(*a*) and 20(*b*), the second arm 47*b* of the toggle lever 47 is integrally formed with a kick body 50. The kick body 50 includes a leftside surface 50*a* and a curved rightside surface 50*b*. When the toggle lever 47 is in the first pivotal position shown in FIG. 20(*a*), then the kick body 50 is positioned out of the leftward and rightward movement pathway of the pressing rib 30*a*. Accordingly, the pressing rib 30*a* can move in the direction B past the kick body 50 without being interfered with by the kick body 50.

In this condition, the pressing rib 30*a* moves in the direction B from the original position indicated by the two dot chain line in FIG. 20(*a*) to the first predetermined position X1 indicated by the solid line, then the pressing rib 30*a* presses against the abutment rib 43*b*, and moves the shift lever 43 in the direction B to the second position X2 shown in FIG. 20(*b*). As a result, the toggle lever 47 is pivoted into its second pivotal position shown in FIG. 20(*b*). The kick body 50 is pivoted in association with this pivotal movement so that the leftside surface 50*a* of the kick body 50 is positioned within the leftward and rightward movement pathway of the pressing rib 30*a*.

Accordingly, when the carriage 30 moves back in the direction C from the second position X2 to a third position X3 indicated by a two-dot chain line in FIG. 20(*b*), the pressing rib 30*a* hits against the leftside surface 50*a* of the kick body 50, and forcibly pivots the toggle lever 47 back in the clockwise direction so that the toggle lever 47 returns to its original posture shown in FIG. 20(*a*).

Figure 22:
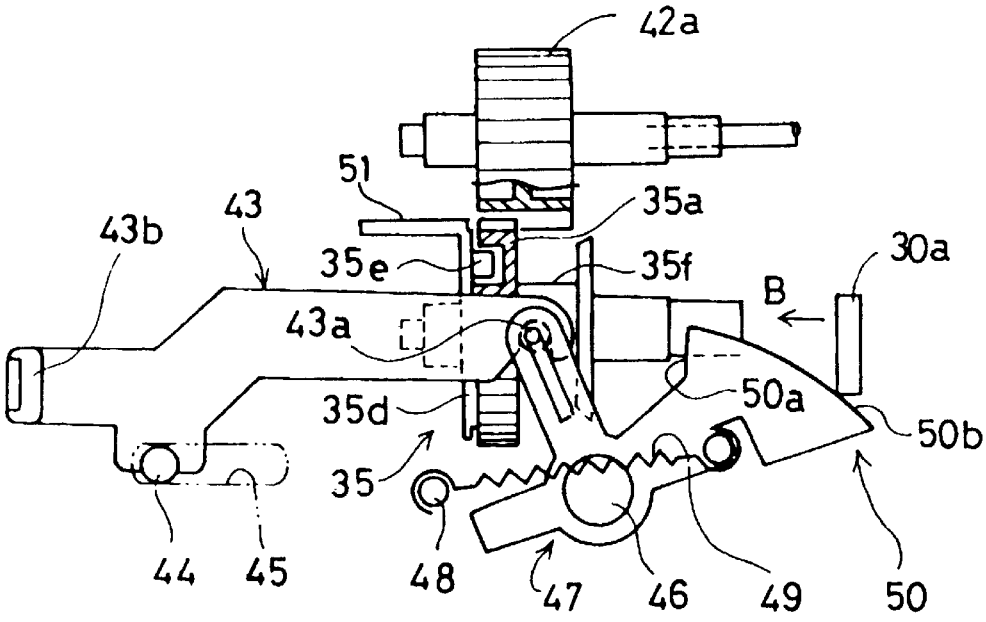
FIG. 22(*a*) is a plan view showing the clutch in an ON condition not due to a pressing rib.
Figure 22:
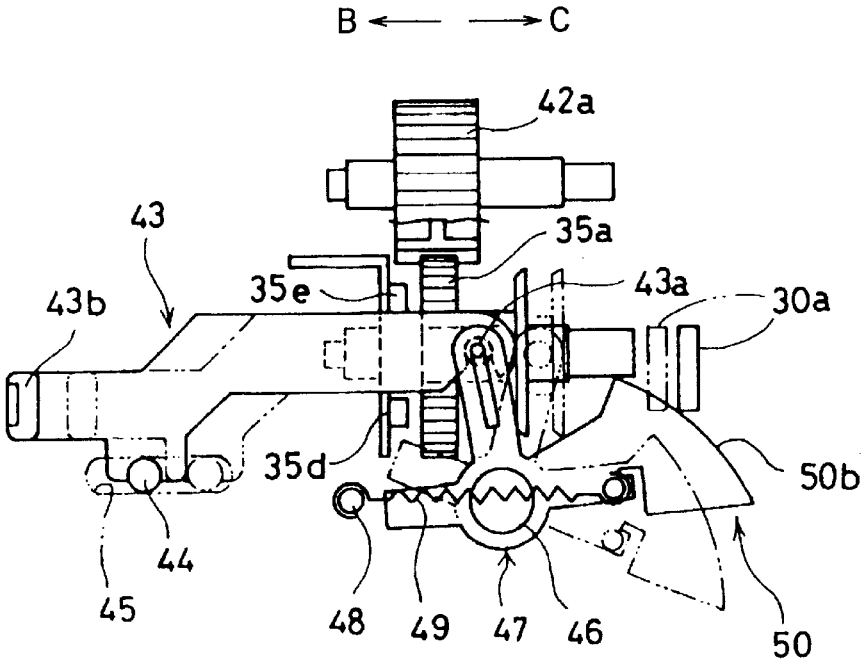

There may possibly occur that the toggle lever 47 is positioned in the second pivotal position shown in FIG. 22(*a*) even while the pressing rib 30*a* is positioned on the right side of the kick body 50, such as indicated by the solid line in FIG. 22(*a*). That is, some external force, such as movement of the printer 1 when it is shipped from the factory or otherwise transported, can pivot the toggle lever 47 counterclockwise as shown in FIG. 22(*a*). In this case, the ink supply clutch 35 is brought into its ON condition, wherein drive power can be transmitted to the cam 51.

According to the present embodiment, it is possible to return the clutch 35 back to the OFF condition in a manner described below.

As shown in FIG. 22(*a*), the curved rightside surface 50*b* of the kick body 50 faces the pressing rib 30*a*. Accordingly, the carriage 30 is controlled to move in the leftward direction B. The pressing rib 30*a* abuts and slides against the curved surface 50*b*. While the pressing rib 30*a* slides along the curved surface 50*b*, the pressing rib 30*a* presses the kick body 50 to forcibly pivot clockwise. That is, the kick body 50 is applied with a clockwise directional force. As a result, the kick body 50 is forcibly pivoted clockwise from the second pivotal position (power transmission position) of FIG. 22(*a*), via a lock release pivotal position indicated by a solid line in FIG. 22(*b*), and back to the first pivotal position (power interrupt position), indicated by the two-dot chain line in that figure. Thus, the toggle lever 47 is forcibly pivoted clockwise into the first pivotal position shown in FIG. 20(*a*). Thus, the kick body 50 is pressed and moved by the pressing rib 30*a*, and the toggle lever 47 is pivoted in the clockwise direction. This pivotal movement separates the engagement recesses 35*c* of the drive clutch body 35*a* from the engagement pawls 35*e* of the follower clutch body 35*d* so that the locked condition is released and transmission of drive force is interrupted.

In the above-described manner, when the toggle lever 47 is properly in the second pivotal position shown in FIG. 20(*b*), the follow clutch body 35*d* is engaged with the drive clutch body 35*a*. Rotational power from the motor 38 can be properly transmitted to the cam 51, which is provided to the follow clutch body 35*d*.

As shown in FIG. 13, the spiral shaped surface of the cam 51 is in abutment contact with the pivot lever 53, which is constantly urged into the upward tilting posture shown in that figure. The limit switch 51*a* is provided adjacent to the cam 51 for being capable of contacting the spiral shaped surface of the cam 51. When the limit switch 51*a* is contacted with the surface of the cam 51, the limit switch 51*a* is in an ON condition. When the limit switch 51*a* is not contacted with the surface of the cam 51, the limit switch 51*a* is in an OFF condition.

In order to downwardly move all the hooks 58 on the pellet dispensing mechanism 52 once, the cam 51 is rotated clockwise: from its starting position shown in FIG. 13 where the pivot lever 53 is contacted with the innermost part of the cam surface 51; via a middle position shown in FIG. 14 where the pivot lever 53 is contacted with the middle part of the cam surface 51; to a final position shown in FIG. 15 where the pivot lever 53 is contacted with the outer part of the cam surface. Then, the cam 51 is rotated counterclockwise to return from the final position via the middle position back to the starting position. It is noted that when the cam 51 is at the starting position of FIG. 13, the switch 51*a* is contacted with the outermost side of the cam surface 51 and therefore is in an ON condition. After the cam 51 starts rotating from the starting position, the switch 51*a* is separated from the cam surface and therefore is brought into an OFF condition. When the cam 51 rotates via the middle position of FIG. 14 to reach the final position of FIG. 15, the switch 51*a* is again brought into contact with the cam surface 51 and therefore turns ON. It is noted that the CPU 10 determines that the cam 51 is in a standby condition when the switch 51*a* is in the ON condition before starting the above-described operation of the pellet dispensing mechanism 52.

With the above-described structure, the limit switch 51*a* determines timings for driving the pellet dispensing mechanism 52 by the motor 38 as described below.

When the ink supply clutch 35 is in ON condition, if the limit switch 51*a* is in an ON condition, it is determined that the cam 51 is in the standby condition. Accordingly, the motor 38 is started to rotate in a reverse direction so as to start rotating the cam 51 clockwise as viewed in FIG. 13. When the limit switch 51*a* is turned OFF, the innermost part of the cam surface starts contacting the pivot lever 53, whereupon the pivot lever 53 starts pivoting downwardly. The motor 38 is continuously driven in the reverse rotational direction for a predetermined number of pulses so that the cam 51 rotates a predetermined angle, which is less than one complete rotation, that is, from the starting position of FIG. 13 via the middle position of FIG. 14 to the final position of FIG. 15. When the cam 51 reaches the final position of FIG. 15, the limit switch 51*a* turns ON, whereupon the drive motor 38 stops rotating.

Afterward, the drive motor 38 starts rotating the same predetermined number of pulses in the forward rotational direction to rotate the cam 51 backward from the final position of FIG. 15 to the starting position. After the cam 51 starts rotating counterclockwise from the position of FIG. 15, the limit switch turns OFF. The cam 51 continuously rotates via the position of FIG. 14 to the position of FIG. 13, whereupon the limit switch again turns ON, and the motor 38 stops rotating.

During the motor 38 is thus driven the predetermined rotational amount in the rearward direction and then in the forward direction as described above, the cam 51 presses the pivot lever 53 from the upward tilting posture of FIG. 13, downward into the reclining posture of FIG. 15, and then allows the pivot lever 53 to move back into the upward tilting posture. In other words, by reciprocally rotating the cam 51 using the reverse and forward rotation of the drive motor 38, this single reciprocal rotation of the cam 51 drives the pivot lever 53 to reciprocally pivot once in the vertical direction. As a result, all the hooks 58 on the pellet dispensing mechanism 52 move downwardly once. One of the hooks 58, that confronts a corresponding abutting protrusion 67, pivots around the shaft 54*a* to engage with a corresponding pin 620, thereby causing the corresponding pressing body 61 to press the ink pellet 22 out of the ink case 8.

With the above-described structure, the carriage 30 and the clutch 35 cooperate with the ink pellet dispensing mechanism 52 to perform ink supply operation as described below.

When repeated printing operations consume ink to the extent that the remaining ink amount sensor 117 detects that certain color ink has run out, then the carriage 30 is controlled to move in the leftward direction B so that the pressing rib 30*a* reaches the first predetermined position X1 in FIG. 20(*a*). Then, the carriage 30 is further moved leftwardly so that the pressing rib 30*a* presses against the abutment rib 43*b* of the shift lever 43 to the left and finally reaches the second predetermined position X2 in FIG. 20(*b*). Accordingly, the toggle lever 47 pivots counterclockwise to turn ON the ink supply clutch 35, whereupon drive force can be transmitted from the motor 38 to the cam 51.

Once the toggle lever 47 is pivoted in this manner, the toggle lever 47 will not pivot clockwise even when the carriage 30 moves rightwardly. That is, the toggle lever 47 will not pivot clockwise until the pressing rib 30*a* reaches the third position X3 in FIG. 20(*b*), and presses against the kick body 50. Thus, the ink supply clutch 35 will remain ON while the pressing rib 30*a* is moved between the second position X2 and the third position X3. An ink supply range is therefore defined along the guide shaft 31 between the second position X2 and the third position X3.

Next, the carriage 30 is controlled to move in order to position its empty melting hopper 20 below a corresponding discharging section 21A of the ink case 8. That is, the carriage 30 is moved to either one of the locations shown in FIGS. 17(*a*)–17(*d*) with respect to the ink case 8 and the pellet dispensing mechanism 52. As a result, the pressing rib 30*a* is located in either one of first through fourth ink supply positions S1–S4 as indicated by dotted line in each figure. When the rib 30*a* is located in each of the first through fourth ink supply positions S1–S4, a corresponding hook abutting protrusion 67 becomes in alignment with the corresponding hook 58 of the pellet dispensing mechanism 52. For example, when the black color hopper has been run out, the carriage 30 is moved to reach the position shown in FIG. 17(*a*) where the pressing rib 30*a* reaches the first ink supply position S1. The hook abutting protrusion 67*k* confronts the hook 58*k*.

It is noted that all the first through fourth ink supply positions S1–S4 are located within the range between the second and third reference positions X2 and X3 shown in FIG. 20(*b*). Accordingly, while the carriage 30 is moved to position the pressing rib 30*a* to any of the first through fourth ink supply positions S1–S4, the toggle lever 47 will not pivot clockwise and therefore the ink supply clutch 35 will maintain its ON state.

When the carriage 30 is thus controlled to reach the desired one of the four locations of FIGS. 17(*a*)–17(*d*), the drive motor 38 is controlled to start rotating in the reverse direction, whereupon the pivot control mechanism 150 in the pellet dispensing mechanism 52 will move in the vertical direction one time so that one ink pellet 22 in the desired color drops into the run out melting hopper 20.

It is noted that when the carriage 30 is originally in the printing region 32, the ink supply clutch 35 will be remained OFF even when the carriage 30 enters the ink supply portion 33 until the pressing rib 30*a* reaches the first predetermined position X1 of FIG. 20(*a*) and presses against the shift lever 43. At the first position X1, the pressing rib 30*a* merely contacts the abutment rib 43*b* of the shift lever 43, but does not press against the abutment rib 43*b* and does not trigger the toggle lever 47. Accordingly, it is possible to move the carriage 30 from the printing portion 32 leftward to the first predetermined position X1 while maintaining the OFF state of the ink supply clutch 35. Therefore, in between successive printing operations, the carriage 30 may be stopped at this first predetermined position X1 to await printing to be executed next.

In this way, the standby position of the carriage 30 for waiting next printing operations can be located and overwrapped in the ink supply region, which is defined between the second and third positions X2 and X3. Accordingly, the printer 1 can be made smaller and compact in the main scanning direction.

Next, the second power transmission portion 134 will be described with referring to FIGS. 4 and 23. The second power transmission portion 134 is for selectively transmitting drive force from the motor 38 to the maintenance operation portion 34 in order to perform purging operation to forcibly eject ink from the nozzle head 12 and to wind up the roll of paper for wiping the nozzle surface and for absorbing purged ink.

In the maintenance operation portion 34, the gear 76*c* is connected to an air pump (not shown) for performing purge operations. When the gear 76*c* is rotated, the air pump is driven to pressurize inside of the print head portion 19 so that ink is forcibly ejected from the nozzle head 12 along with bubbles and foreign matter. Purge operations return clogged nozzles to a condition for proper ejection of ink. Although not shown in the drawings, a maintenance paper supply roller is provided in the maintenance operation portion 34. The shaft of the gear 76*c* is connected to a sheet take-up roller for taking up the maintenance paper from the supply roller. Therefore, the roll of maintenance paper is taken up on the take-up roller when the gear 76*c* rotates. The shaft of the gear 76*c* therefore serves to wind up the roll sheet a predetermined distance while wiping ink and foreign matter from the nozzle surface until an unused portion of the wiped roll sheet is brought into confrontation with the nozzle head 12.

The second power transmission portion 134 is for selectively transmitting power to the gear 76*c* by switching the clutch 36 between its ON and OFF conditions according to movement of the carriage 30 toward and away from the maintenance operation portion 34.

The clutch 36 includes: a sun gear 71; a planetary arm 72 pivotably supported on a shaft 71*a* of the sun gear 71; a planetary gear 73 rotatably supported on the planetary arm 72 in constant meshing engagement with the sun gear 71; and a follower gear group 76. The sun gear 71 is constantly in meshing engagement with the gear 70, which is fixed to the right end of the rotational shaft 39 opposite from the drive motor 38. The planetary gear 73 is rotatably supported on the planetary arm 72 constantly in meshing engagement with the sun gear 71. The follower gear group 76 is constructed from a two speed gear (speed reduction gear) 76*a* and the gear 76*c* for performing the maintenance operation portion. The two speed gear 76*a* has a larger diameter gear and a smaller diameter gear. The gear 76*c* is constantly in meshing engagement with the smaller diameter gear of the two speed gear 76*a*. The planetary gear 73 can be selectively brought into meshing engagement with the larger diameter gear of the two speed gear 76*a*.

A pressing arm 74 is pivotably supported about its shaft 75 to the frame (not shown) of the printer 1. The pressing arm 74 is provided with a pressing portion 74*a* protruding leftwardly from its left side surface. Although not shown in the drawings, a spring is provided for downwardly urging the pressing portion 74*a* of the pressing arm 74.

A pressing lever 77 is pivotably supported to the frame (not shown) of the printer 1 at a position in confrontation with the front side surface of the pressing arm 74. The pressing lever 77 is pivotably supported on its pivot shaft 78. A bevel gear 79 is attached to one end of the pivot shaft 78. A pivot lever 81 is pivotably supported to the frame (not shown) of the printer 1 at a position adjacent to the bevel gear 79 and in confrontation with the front side surface of the pressing arm 74. Another bevel gear 80 is attached to the pivotal shaft of the pivot lever 81. The bevel gear 80 is constantly in meshing engagement with the bevel gear 79. A free end of the pivot lever 81 is located in the leftward and rightward movement pathway of the carriage 30.

With the above-described structure, the tip end of the pressing portion 74*a* normally presses the upper tip end of the planetary arm 72 downward. Accordingly, as indicated by a solid line in FIG. 23, the planetary gear 73 is separated from and out of engagement with the larger diameter gear of the two speed gear 76*a*.

On the other hand, when the carriage 30 moves to the right of FIG. 4 to enter the maintenance operation portion 34, the rightside wall of the carriage 30 abuts against the upper free end of the pivot lever 81. As a result, the pivot lever 81 pivots to the right in FIG. 4, whereupon the bevel gears 80 and 79 rotate, and the pressing lever 77 is pivoted about the pivot shaft 78 in a clockwise direction as indicated by an arrow in FIG. 23. The pressing lever 77 presses the pressing arm 74 so that the pressing arm 74 is also pivoted clockwise about its pivot shaft 75. The pressing portion 74*a* therefore moves upwardly to separate from the upper tip of the planetary arm 72.

Figure 23:
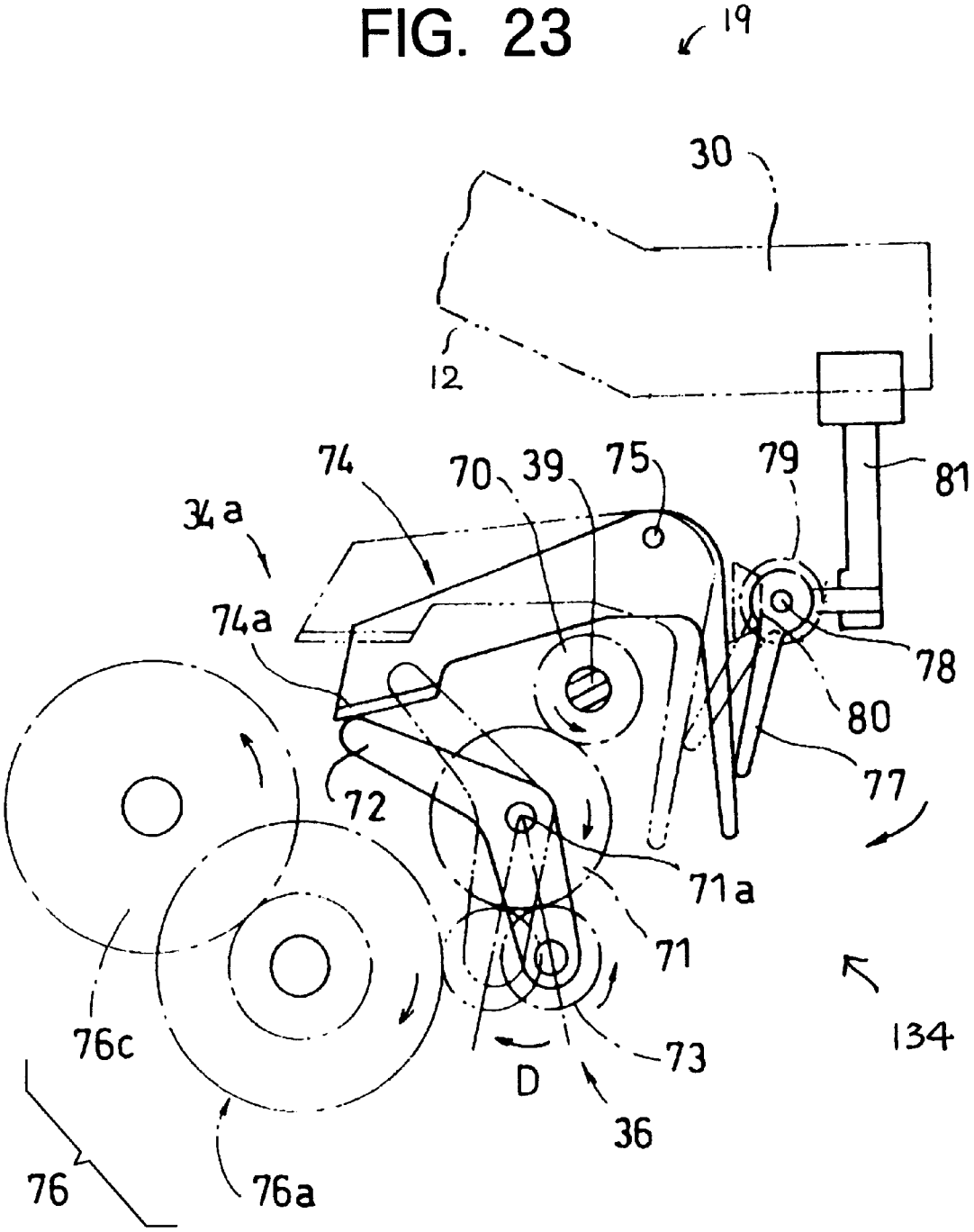
FIG. 23 is a side view showing the clutch in the maintenance operation portion.

In this condition, when the drive motor 38 is rotating in the rearward direction and therefore the sun gear 71 is being driven to rotate in the clockwise direction as shown in FIG. 23, the planetary gear 73 rotates while revolving around the sun gear 71 in the clockwise direction. As a result, the planetary gear 73 is brought into engagement with the greater diameter gear of the two speed gear 76*a*. Thus, the reverse rotational power from the drive motor 38 is transmitted to the sheet take-up shaft via the gear 76*c*. Although not shown in FIG. 23, the pressing arm 74 is provided with a pressing plate for pressing a portion of the sheet, suspended between the supply roll and the take-up shaft, against the nozzle surface. Because the pressing arm 74 is now in the position indicated by the two-dot chain line in FIG. 23, the pressing plate on the pressing arm 74 can press a portion of the paper against the surface of the nozzle head 12 to facilitate wiping away ink and foreign matter from the surface of the nozzle head 12.

On the other hand, when the drive motor 38 rotates in the forward direction, the sun gear 71 rotates counterclockwise as viewed in FIG. 23. Accordingly, the planetary gear 73 rotates while revolving around the sun gear 71 in the counterclockwise, thereby separating from the two speed gear 76*a*. Although not shown in the drawings, a stopper mechanism is provided to prevent the planetary arm 72 from pivoting beyond a predetermined angle in this separated condition.

Maintenance operations are automatically executed each time print operations are executed for a predetermined length of time. Maintenance operations are also executed when a manual maintenance switch is operated. During the maintenance operations, the carriage 30 is controlled to move to the rightward direction C in FIG. 4 to enter the maintenance operation portion 34 until abutting against the pivot lever 81. As a result, the pressing arm 74 pivots upward via the pressing lever 77, whereupon the planetary arm 72 is brought into a condition that the arm 72 can freely pivot around the axis 71*a*.

In this condition, the drive motor 38 is controlled to rotate in the reverse direction in a predetermined number of times so that the gear 70 rotates counterclockwise and the sun gear 71 rotates clockwise as indicated by arrows in FIG. 23. As a result, the planetary gear 73 will pivot around the sun gear 71 in a direction indicated by an arrow D in FIG. 23 while rotating in the counterclockwise direction. When the planetary gear 73 abuts against and meshingly engages with the larger diameter gear of the two speed gear 76*a*, then the reverse rotational force of the drive motor 38 is transmitted to the gear 76*c*. The rotation of the gear 76*c* is transmitted to the air pump (not shown) to start purge operations. That is, the air pump starts pressurizing inside of the print head 19 so that ink is forcibly ejected from the nozzle head 12 25 along with bubbles and foreign matter. Purge operations return clogged nozzles to a condition for proper ejection of ink. During this purging operation, the roll sheet (not shown in the drawings) is wound up a predetermined distance on the take-up shaft connected to the rotational shaft of the gear 76*c*. At this time, ink ejected from the nozzles is received by the roll sheet and removed in association with the wind up movement of the roll sheet. The sheet wipes ink and also the foreign matter from the nozzle surface. An unused portion of the wiped roll sheet will then be brought into confrontation with the nozzle head 12. Because the winding up of the roll sheet is performed simultaneously when the nozzle head 12 is purged to forcibly eject ink, ink ejected from the nozzles is received by the roll sheet and removed in association with the wind up movement of the roll sheet. Wiping operations of the roll sheet are completed when the rotation of the drive motor 38 is stopped.

When the above-described maintenance operations are completed, the carriage 30 is controlled to start moving back to the print portion 32 in the leftward direction B in FIG. 4. As a result, the carriage 30 moves away from the pivot lever 81. In association with this movement, the pressing arm 74 is returned to its original posture indicated by the solid line in FIG. 23, thereby separating the planetary gear 73 from the two speed gear 76*a* and accordingly cutting OFF transmission of power from the drive motor 38 to the gear 76*c*.

As described already, the discharge rollers 18 are mounted on the drive shaft 39 driven by the motor 38. The transport rollers 15 are mounted on the shaft 115 also driven by the motor 38. Although not shown in the drawings, the printer 1 is provided with another power transmission mechanism (gear trains) for transmitting power of the motor 38 to the sheet supply rollers 11*a* and 11*b* and the resist rollers 13*a* and 13*b*. All the discharge rollers 18, the sheet supply rollers 11*a* and 11*b*, the resist rollers 13*a* and 13*b*, and the transport rollers 15 are driven to perform their operations using forward directional drive of the drive motor 38.

When desiring to supply a recording sheet to the printer 1, the carriage 30 is first stopped at the standby position where the pressing rib 30*a* is positioned in the first predetermined position X1 in FIG. 20(*a*).

Then, a user presses a sheet supply switch, or a sheet supply command is issued from the host computer (not shown) connected to the printer 1. As a result, the motor 38 starts driving in its forward direction. One of the sheet supply rollers 11*a* and 11*b* is selectively driven to supply a single sheet of recording sheet P from the corresponding sheet supply unit 2 or 3. At the start of sheet supply, rotation of the corresponding resist rollers 13*a* or 13*b* is temporarily stopped to perform a resist operation for aligning the front edge of the recording sheet P. After the resist operations are completed, the recording sheet P is transported by the transport rollers 15, before being temporarily stopped when the leading edge of the sheet P is sandwiched between the discharge rollers 18 and their pinch roller 18*a*.

Then, printing is performed while the carriage 30 is scanned along the guide shaft 31. During the printing operation, the recording sheet P is also fed using the forward directional rotation of the single drive motor 38. That is, the forward rotation of the drive motor 38 drives the resist rollers 13*a* and 13*b*, the transport rollers 15, and the discharge rollers 18 to rotate in the direction for transporting and discharging the recording sheet P.

At this time, the transport rollers 15 rotate in the same direction as the discharge rollers 18. In this case, as described above, the gear 70 in the second power transmission portion 134 rotates clockwise, and the sun gear 71 rotates counterclockwise as viewed in FIG. 23. The planetary gear 73 revolves around the sun gear 71 while rotating itself and separates from the two speed gear 76*a*. Therefore, wind up operations of the roll sheet are not performed. Further, the ink supply clutch 35 is in the OFF condition, and therefore ink supply is not performed.

With the above-described structure, the printer 1 operates as described below.

In between successive printing operations, the CPU 100 controls the carriage drive circuit 104 to move the carriage 30 to the standby position shown in FIG. 20(*a*), which is located in the ink supply portion 33 shown in FIG. 3. That is, the pressing rib 30*a* is positioned at the first position X1 indicated by the solid line in the figure. In this condition, the ink supply clutch 35 remains OFF. The clutch 36 in the maintenance operation portion 34 also remains OFF. When receiving a sheet supply command from the user or the host computer (not shown), the CPU 100 controls the motor drive circuit 113 to drive the motor 38 in the forward direction, thereby supplying one recording sheet P to the transport passageway TP in FIG. 2.

During normal printing operations, the CPU 100 controls the carriage drive circuit 104 to reciprocally move the carriage 30 in the print region 32 in confrontation with the main platen 16. The CPU 100 controls the motor drive circuit 113 to drive the drive motor 38 to rotate only in its forward direction. As a result, the resist rollers 13*a* and 13*b*, the transport rollers 15, and the discharge rollers 18 are rotated to transport a recording sheet P down the sheet transport pathway TP. The CPU 100 controls the circuit 103 to cause the nozzle head 12 in the head portion 19 to print desired images with ink in its ink tank (not shown). The sheet P printed by the printing operation is discharged out onto the discharge tray 6. When the printing operation is completed, the CPU 100 controls the carriage 30 to move back to the standby position X1 shown in FIG. 20(*a*) for waiting the next printing operation. Thus, successive printing operations are performed.

When the recording head 19 runs out of ink of one color (black color, for example), the CPU 100 receives output of a detection signal from the remaining ink amount sensor 117 indicating that ink has run out, the CPU 100 outputs a predetermined control signal to the carriage drive circuit 104 and the motor drive circuit 113 to indicate that an ink pellet 22 of the run out color should be supplied to the corresponding melting hopper 20 on the carriage 30. Simultaneously, the CPU 100 also controls the head heating control circuit 109 to energize the hopper heater 112 in the melting hopper 20, to be supplied with the ink pellet 22, so that the supplied ink pellet 22 will be quickly melted.

Receiving the control signal from the CPU 100, the carriage drive circuit 104 moves the carriage 30 to the ink supply portion 33, and the motor drive circuit 113 drives the drive motor 38 to rotate both in its forward and rearward directions. As a result, an ink pellet of the desired color is supplied from the ink case 8 to the corresponding melting hopper 20.

More specifically, the CPU 100 controls the carriage 30 to move, via the first position X1, to the second position X2 in FIG. 20(*b*). As a result, the toggle lever 47 pivots counterclockwise, thereby turning ON the ink supply clutch 35. Then, the carriage 30 is further controlled to reach the location shown in FIG. 17(*a*) where the hook abutment portion 67K on the carriage 30 will confront the hook 58K on the pellet dispensing mechanism 52. After confirming that the limit switch 51*a* is in the ON state, the CPU 100 starts driving the motor 38 in the rearward direction by the predetermined amount and then In the forward direction also by the predetermined amount. As a result, the cam 51 reciprocally rotates, whereupon all the four hooks 58K, 58M, 58C, and 58Y move downwardly. Only the hook 58K abuts against the hook abutting protrusion 67K, and engages with the pin 620. As a result, the corresponding pressing body 61K pivots downwardly to press one ink pellet 22 from the discharging section 21A for black ink in the ink case 8. The ink pellet 22 drops due to gravity into the hopper 20 for black, and is thermally melted by the heater 112. After the ink supply operation is completed, the carriage 30 is moved rightwardly so that the pressing rib 30*a* reaches the position X3 to press the kick body 50, thereby turn OFF the clutch 35.

When the printing operation has been performed predetermined length of time or when the user inputs a command to perform the maintenance operation, the CPU 100 first controls the carriage driving circuit 104 to move the carriage 30 to the maintenance operation portion 34. The rightside surface of the carriage 30 abuts against the pivot lever 81, whereupon the pressing arm 74 pivots upwardly, thereby turning the clutch 36 ON. Then, the CPU 100 starts driving the motor 38 in a reverse direction. As a result, the gear 76*c* rotates to actuate the air pump (not shown) to perform purging operation in the nozzle head 12 on the carriage 30, while the take-up shaft, connected to the rotational shaft of the gear 76*c,* winds up the sheet roll (not shown) to wipe ink and the like from the nozzle surface.

As described above, according to the present embodiment, the discharging sections 21A for the respective colors are arranged on the ink case 8 at an interval P in the main scanning direction indicated by the arrows B and C in FIG. 17(*a*). On the carriage 30, the melting hoppers 20 for the respective colors are arranged at an interval T in the main scanning direction. The carriage 30 is also provided with the hook abutting protrusions 67 for the respective colors. The hook abutting protrusions 67 are arranged at an interval R in the main scanning direction. On the pellet dispensing mechanism 52, the hooks 58 for the respective colors are arranged at an interval L in the main scanning direction. The value L is greater than the value R. The carriage 30 is scanningly movable in the main scanning direction. The carriage 30 is moved in the direction B or C to be stopped at an appropriate position with respect to the ink case 8 and the pellet dispensing mechanism 52. When all the hooks 58 are moved, only a selected one hook 58 slides against a corresponding hook abutting protrusion 67, and pivots. As a result, one pressing body 61, which is located above a selected discharging section 21A, is pivoted to downwardly press one ink pellet 22 to a corresponding hopper 20.

The ink supply clutch 35 is provided for selectively actuating the pellet dispensing mechanism 52 to supply ink pellets 22 to the hoppers 20 of the carriage 30. Power from the single drive motor 35 is transmitted through the drive shaft 39 to drive the discharge rollers 18. The power from the drive motor 35 is selectively supplied to: the first power transmission portion 140; the rollers 11, 13, 15, and 18; and the second power transmission portion 134.

The ink supply clutch 35 is provided in the first power transmission portion 140 to selectively transmit the power to the pellet dispensing mechanism 52. When the carriage 30 is moved leftward in the direction B to the position X2 shown in FIG. 20(*b*), the pressing rib 30*a* presses against the abutment rib 43*b* of the shift lever 43, and the shift lever 43 moves also in the direction B. As a result, the ink supply clutch 35 is turned ON. The toggle lever 47 and the urging spring 49 maintains the ON state of the clutch 35. After the ink pellet supplying operation is completed, the carriage 30 is moved backward in the direction C. When the pressing rib 30*a* presses, in the rightward direction C, the rear side 50*a* of the kick portion 50 provided to the toggle lever 47, the ink supply clutch 35 is turned OFF. The toggle lever 47 maintains also the OFF state of the clutch 35.

As described above, the distance P between the adjacent ink discharging sections 21A is different from the distance T between the adjacent ink melting hoppers 20. Accordingly, a discharging section 21A and a hopper 20 of only a selected color of ink can be aligned together by merely controlling scanning movement of the carriage 30 to stop at a particular position. Further, the discharging sections 21A and hoppers 20 of other non-selected colors of ink will not be in alignment so that the wrong colored ink will not be supplied to the selected hopper 20. Thus, when a hopper 20, that has run out of ink, is detected, ink supply can be automatically performed by simply controlling movement and stopping of the carriage 30 in the main scanning direction.

When the carriage 30 is moved and stopped to align its one melting hopper 20, which has run out of ink, with one discharging section 21A, only the corresponding hook abutting protrusion 67, provided to the carriage 30, is positioned so that the posture of the corresponding hook 58 can be changed. Thus, an ink pellet 22 can be pushed down through operation of a pressing body 61 corresponding to the selected hook 58. Because the hook abutting protrusion 67 is provided to the carriage 30, the movement amount and stopping position of the protrusion 67 can be determined merely based on movement amount and stopping position of the carriage 30. Therefore, when one empty melting hopper 20 is detected, supply of ink pellets can be automatically performed by a simple control for setting the movement amount and stopping position of the carriage 30 in the scanning direction.

According to the present embodiment, the four hooks 58 for all the colors are operated all together by the single drive source 38 via the operation of the single pivot lever 53. Therefore, the manufacturing cost of the printer 1 can be reduced.

Also, by disposing the ink supply clutch 35 between the hooks 58 and the drive source 38, timing of operating the drive source 38 itself and timing of driving vertical movement of the hooks 58 can be set separately with extreme ease.

The ink supply clutch 35 is turned ON and OFF by merely controlling the movement of the carriage 30. After the clutch 35 is turned ON, the carriage 30 is moved within the ink supply region to be precisely positioned with respect to the ink dispensing mechanism 52. This movement of the carriage 30 maintains the clutch 35 in the ON condition. Only when the ink carriage 30 moves away from the ink supply region to the print portion 32, the supply clutch is turned OFF. The movement of the carriage 30 in the print portion maintains the clutch 35 in the OFF condition. In this way, the ON and OFF conditions of the clutch 35 can be controlled without providing separate sensors and the like. Therefore, the configuration of the printer 1 is extremely simple.

More specifically, after the carriage 30 has been moved to the second position X2 shown in FIG. 20(*b*) to turn the clutch 35 temporarily ON, it is necessary to move the carriage 30 in an opposite direction the predetermined distance or more to pass the third position X3 in order to turn the clutch 35 back to OFF. This predetermined distance defined between the positions X2 and X3 is set as the ink supply range where all the four ink supply positions S1–S4 shown in FIGS. 17(*a*)–17(*d*) are located.

Accordingly, after the carriage 30 reaches the second position X2 shown in FIG. 20(*b*), the ink supply clutch 35 is locked temporarily in its ON condition. The lock condition is maintained until the carriage 30 is moved a predetermined distance or more in the rightward direction C. The ink supply mechanism, comprised of the ink case 8 and the pellet dispensing mechanism 52, is disposed within this lock region so that supply of different colored inks can be selectively performed onto the carriage 30.

Further, the clutch switches OFF, in association with the carriage 30 being moved in the opposite direction C the predetermined distance or more in order to perform print operations. Thus, control operations can be performed with extreme ease.

Thus, the ON/Off switching operation of the clutch 35 is attained according to the movement of the carriage 30 through the positions X1, X2, and X3. The ON/OFF switching operation of the clutch 35 is associated with the control to selectively stop the carriage 30 at the four ink supply positions S1–S4 for supplying ink of corresponding colors to the carriage 35. That is, while the carriage 30 is moved the distance of (3P–3T) between the ink supply positions S1 and S4, the clutch 35 is maintained ON because all the ink supply positions S1–S4 are located between the positions X2 and X3. In each of the ink supply positions S1–S4, ink supply of only one corresponding color is reliably attained. That is, only one selected hook 58 actuates the corresponding pressing body 61, while the remaining hooks 58 being restricted not to actuate the corresponding pressing bodies 61.

When ink supply is not being executed, the carriage can be moved to the first position X1 shown in FIG. 20(*a*) just before the ink supply clutch 35 is turned ON. Therefore, this position is set to as the print standby position where the carriage 30 waits for printing to be performed. Thus, the print standby position is defined as overlapped with the ink supply range in the scan direction of the carriage. Therefore, the leftward and rightward dimension of the printer 1 can be made smaller so that the printer 1 can be made more compact in general.

Even if the ink supply clutch 35 is accidentally turned ON when the printer 1 is transported or shaken, the clutch 35 can be reliably turned OFF by merely moving the carriage 30 into its print standby position. Since this is performed without any particular operations by an operator, returning the clutch 35 to its OFF condition is easily performed.

According to the present embodiment, rotational force from the single drive source 38 can be transmitted selectively to the ink supply portion 30 and to another unit of the printer 1, such as the rollers 11, 13, 15, and 18 and the maintenance operation portion 34. There is no need to provide separate drive sources for each unit of the printer 1 so that the cost of manufacturing the printer 1 can be reduced. Because the clutch 35 is provided to receive the power from the drive source to supply it to the ink supply portion 33, it is possible to reliably and selectively switch transmission of the drive power to the ink supply portion 33.

When the carriage 30 is moved toward the ink supply portion 33, transmission of the power is turned ON, and when the carriage 30 is moved away from the ink supply portion 33, transmission of the power is turned OFF. With this configuration, by selectively moving the carriage 30, the transmission of power can be turned ON and OFF by the clutch 35 so that control is easy. Accordingly, there is no need to provide a separate drive source for driving transport operations of the recording medium and ink supply operations of the ink supply portion 33. Both types of operations can be performed using the same drive source 38.

There is no need to provide a separate drive source for driving the ink supply operations and the maintenance operations separately. Both types of operations can be executed using the same drive source.

Accordingly, the number of necessary parts becomes small so configuration is simple. Supply of ink to the hot melt ink jet print head 19 can be made simple and reliable.

While the invention has been described in detail with reference to the specific embodiment thereof, it would be apparent to those skilled in the art that various changes and modifications may be made therein without departing from the spirit of the invention.

For example, the above-described embodiment relates to a mechanism for supplying the hoppers 20 with the ink pellets 22 which are formed from hot melt ink in solid form. However, the mechanism can be modified to supply liquid ink instead. In this case, each ink pellet associating groove 21 in the ink case 8 may be constructed in tank form and made from a flexible material for storing liquid ink separately by color. The ink case 8 is constructed from four ink dispensing tanks 21 which are aligned in, and separated by, the appropriate distance P in the main scanning direction of the carriage 30. The pressing bodies 61 may be designed to press and squeeze the flexible ink dispensing tanks 21 so that ink can be selectively dispensed from the ink dispensing tanks 21. The pressing bodies 61 are selectively driven by the hooks 58, which are disposed separated by the distance L that differs from the distance P that separates the ink dispensing tanks 21. The pressing bodies 61 can selectively press the ink dispensing tanks 21 to discharge a desired color of ink from one ink dispensing tank 21.

When desiring to supply the carriage with ink of a desired color, the carriage 30 is moved to position a hook abutting protrusion 67, corresponding to that color, in confrontation with a pressing body 61 that is located in front of the ink dispensing tank 21 for that color. The hook abutting protrusion 67 can actuate the corresponding one pressing body 61 to press the ink dispensing tank 21 to discharge the desired color of ink.

The distance P between the ink dispensing tanks 21 and the distance T between the receiving hoppers 20 are different from each other. Accordingly, the dispensing tank 21 and the hopper portion 20 of only a selected color of ink can be aligned together by merely controlling scanning movement of the carriage 30 to stop at a particular position. Further, the dispensing tanks 21 and hopper portions 20 of other non-selected colors of ink will not be in alignment so that the wrong colored ink will not be supplied to the selected hopper 20. Thus, when a hopper 20, that has run out of ink, is detected, ink supply can be automatically performed by simply controlling movement and stopping of the carriage 30 in the main scanning direction.

In the above-described embodiment, all the four pellet discharging sections 21A are arranged in the same amount of interval P. However, the four pellet discharging sections 21A may be arranged at non-uniform intervals P. That is, the distance Pym between the pellet discharging sections 21A for yellow and magenta, the distance Pmc between the pellet discharging sections 21A for magenta and cyan, and the distance Pck between the pellet discharging sections 21A for cyan and black may be different from one another. In this case, the positions of the pressing bodies 61 are shifted to confront the corresponding pellet discharging sections 21A. The four hoppers 20 are arranged at non-uniform intervals T. That is, the distance Tym between the hoppers 20 for yellow and magenta, the distance Tmc between the hoppers 20 for magenta and cyan, and the distance Tck between the hoppers 20 for cyan and black are different from one another. Similarly, the hooks 58 are arranged at non-uniform intervals L. That is, the distance Lym between the hooks 58 for yellow and magenta, the distance Lmc between the hooks 58 for magenta and cyan, and the distance Lck between the hooks 58 for cyan and black are different from one another. Similarly, the hook abutting protrusions 67 are arranged at non-uniform intervals R. That is, the distance Rym between the hook abutting protrusions 67 for yellow and magenta, the distance Rmc between the hook abutting protrusions 67 for magenta and cyan, and the distance Rck between the hook abutting protrusions 67 for cyan and black are different from one another.

In this modification, the distances Pym, Pmc, Pck, Tym, Tmc, Tck, Lym, Lmc, Lck, Rym, Rmc, and Rck should satisfy the following inequalities: Tym≠Pym, Tmc≠Pmc, Tck≠Pck, Lym≠Rym, Lmc≠Rmc, and Lck≠Rck. Preferably, the distances Pym, Pmc, Pck, Tym, Tmc, Tck, Lym, Lmc, Lck, Rym, Rmc, and Rck should satisfy the following inequalities: Tym<Pym, Tmc<Pmc, Tck<Pck, Lym>Rym, Lmc>Rmc, and Lck>Rck.

For example, when the distances Pym, Pmc, and Pck satisfy the following equations: Pym=P, Pmc=P+α, and Pck=P+β, the distances Tym, Tmc, Tck, Lym, Lmc, Lck, Rym, Rmc, and Rck are preferably set to satisfy the following equations: Tym=T, Tmc=T+t α, and Tck=T+t β, Lym=L, Lmc=L+s α, and Lck=L+s β, and Rym=R, Rmc=R+r α, and Rck=R+r β. Because T≠P and L . R, Pym, Pmc, Pck, Tym, Tmc, Tck, Lym, Lmc, Lck, Rym, Rmc, and Rck satisfy the following inequalities: Tym≠Pym, Tmc≠Pmc, Tck≠Pck, Lym≠Rym, Lmc≠Rmc, and Lck≠Rck.

In another example, only the distance Pck can be set larger than the other distances Pym and Pmc. That is, the size of the pellet 22 for black ink may be designed larger than the pellets 22 for the other colors. In this case, Pym, Pmc, and Pck satisfy the following equations: Pym=P1, Pmc=P1, and Pck=P2 (P2>P1). The distances Tym, Tmc, Tck, Lym, Lmc, Lck, Rym, Rmc, and Rck are preferably set to satisfy the following equations: Tym=T1, Tmc=T1, and Tck=T2 (T2>T1), Lym=L1, Lmc=L1, and Lck=L2 (L2>L1), and Rym=R1, Rmc=R1, and Rck=R2 (R2>R1). Because T1≠P1, T2≠P2, L1≠R1, and L2≠R2, Pym, Pmc, Pck, Tym, Tmc, Tck, Lym, Lmc, Lck, Rym, Rmc, and Rck satisfy the following inequalities: Tym≠Pym, Tmc≠Pmc, Tck≠Pck, Lym≠Rym, Lmc≠Rmc, and Lck≠Rck.

Similarly, the number of nozzles for black, provided on the carriage 30, may be set greater than those for other colors. Also in this case, the distances Tym, Tmc, and Tck are set to satisfy the following equalities: Tym=T1, Tmc=T1, and Tck=T2 (T2>T1). Accordingly, the distances Pym, Pmc, Pck, Lym, Lmc, Lck, Rym, Rmc, and Rck are preferably set to satisfy the following equations: Pym=P1, Pmc=P1, and Pck=P2 (P2>P1), Lym=L1, Lmc=L1, and Lck=L2 (L2>L1), and Rym=R1, Rmc=R1, and Rck=R2 (R2>R1). Because T1≠P1, T2≠P2, L1≠R1, and L2≠R2, Pym, Pmc, Pck, Tym, Tmc, Tck, Lym, Lmc, Lck, Rym, Rmc, and Rck satisfy the following inequalities: Tym≠Pym, Tmc≠Pmc, Tck≠Pck, Lym≠Rym, Lmc≠Rmc, and Lck≠Rck.

What is claimed is:

1. An ink supply device for use in an ink jet printer, the ink supply device comprising:

a carriage capable of being moved in a scanning direction within a scanning region, the scanning region including an ink supply region, the carriage being provided with a plurality of hoppers for receiving ink of a plurality of different colors, respectively, the hoppers being arranged in the scanning direction;

an ink storing unit, disposed in the ink supply region, for storing ink of the plurality of different colors, the ink storing unit including a plurality of ink supplying portions each for supplying ink of a corresponding color, the plurality of ink supplying portions being arranged in the scanning direction, distances between the ink supply portions along the scanning direction being different from distances between the hoppers on the carriage along the scanning direction; and a carriage scanning control mechanism for controlling the carriage to move in the scanning direction, the carriage scanning control mechanism selectively stopping the carriage at a plurality of predetermined different stopping positions relative to the ink storing unit, thereby selectively controlling the ink supplying portions to supply ink of the corresponding colors from the ink storing unit to the corresponding hoppers according to the plurality of predetermined different stopping positions of the carriage, the plurality of predetermined different stopping positions being defined in correspondence with the plurality of different colors, respectively, wherein the carriage scanning control mechanism selectively stops the carriage at a desired stopping position, thereby allowing a corresponding hopper to be aligned with a corresponding ink supply portion while preventing remaining hoppers from being aligned with remaining ink supply portions, and controls the corresponding ink supply portion to supply ink of the corresponding color to the aligned, corresponding hopper.

2. An ink supply device as claimed in claim 1, wherein the hoppers are arranged in the scanning direction at a first interval in the scanning direction, and the plurality of ink supplying portions are arranged in the scanning direction at a second interval, the second interval being different from the first interval.

3. An ink supply device as claimed in claim 1, further comprising an ink supply control unit disposed in the ink supply region, the ink supply control unit being capable of causing each ink supplying portion to supply a corresponding hopper with ink of a corresponding color, the ink supply control unit causing a selected one ink supply portion to supply its corresponding hopper with ink of the corresponding color in accordance with the stopping position of the carriage.

4. An ink supply device as claimed in claim 3, wherein the carriage includes an actuating mechanism for actuating, based on the stopping position of the carriage, the ink supply control unit to cause the selected one ink supply portion to supply its corresponding hopper with ink of the corresponding color.

5. An ink supply device as claimed in claim 4, wherein the ink supply control unit includes a plurality of supply control portions, each capable of controlling a corresponding ink supplying portion to supply ink of a corresponding color to a corresponding hopper in accordance with a stopping position of the carriage.

6. An ink supply device as claimed in claim 5, wherein the actuating mechanism includes a plurality of actuating portions which are arranged in the scanning direction, and wherein the plurality of supply control portions are arranged in the scanning direction, distances between the supply control portions along the scanning direction being different from distances between the actuating portions along the scanning direction, each of the plurality of supply control portions being actuated by a corresponding actuating portion in accordance with the stopping position of the carriage, thereby controlling the corresponding supplying portion to supply ink of the corresponding color to the corresponding hopper.

7. An ink supply device as claimed in claim 6, wherein the actuating portions are arranged in the scanning direction at a third interval, and the plurality of supply control portions are arranged by a fourth interval in the scanning direction, the fourth interval being different from the third interval.

8. An ink supply device as claimed in claim 6, further comprising:

a power source for generating power;

an ink supply clutch for selectively transmitting power to the ink supply control unit, in accordance with movement of the carriage, thereby bringing all the plurality of supply control portions into a condition actuatable by the corresponding actuating portion.

9. An ink supply device as claimed in claim 8, further comprising:

a clutch locking unit for locking the ink supply clutch in a first condition to transmit power to the ink supply control unit at a first timing when the carriage moves to reach a first predetermined position; and a clutch unlocking unit for unlocking the ink supply clutch from the first condition to a second condition not to transmit power to the ink supply control unit when the carriage moves to reach a second predetermined position after the first timing, wherein a stopping position of the carriage, where each supply control portion causes the corresponding ink supply portion to supply the corresponding hopper with ink of the corresponding color, is located between the first and second predetermined positions.

10. An ink supply device as claimed in claim 3, wherein the ink storing unit stores ink of the plurality of different colors in liquid form.

11. An ink supply device as claimed in claim 3, wherein the ink storing unit stores a plurality of hot melt ink pellets of the plurality of different colors, each of the plurality of ink supplying portions being for supplying an ink pellet of a corresponding color, each of the hoppers on the carriage including a heater for thermally heating the received ink pellet.

12. An ink supply device as claimed in claim 11, wherein the ink storing unit includes an ink case for storing the hot melt ink pellets of the plurality of different colors, the ink case having a plurality of pellet discharging sections capable of discharging the ink pellets of the corresponding colors, the plurality of pellet discharging sections being arranged in the scanning direction, distances between the pellet discharging sections along the scanning direction being different from the distances between the hoppers along the scanning direction.

13. An ink supply device as claimed in claim 12, wherein the ink case is positioned so that each pellet discharging section is capable of being located above a corresponding hopper in accordance with the stopping position of the carriage, wherein the supply control unit includes:

a plurality of pressing bodies, each being located so as to be capable of downwardly pressing an ink pellet out of the corresponding discharging section and allowing the ink pellet to drop into the corresponding hopper; and a plurality of engagement/disengagement bodies each being capable of changing its posture from a first posture not to cause a corresponding pressing body to press an Ink pellet out of the corresponding discharging section into a second posture to cause the corresponding pressing body to press an ink pellet out of the corresponding discharging section, and wherein the carriage is provided with a selectively regulating mechanism for selectively changing the posture of one of the engagement/disengagement bodies, in accordance with stopping position of the carriage, from the first posture to the second posture, thereby causing the corresponding pressing body to press an ink pellet out of the corresponding discharging section.

14. An ink supply device as claimed in claim 13, wherein the plurality of engagement/disengagement bodies are arranged in the scanning direction at predetermined engagement/disengagement intervals, and wherein the selectively regulating mechanism includes a plurality of regulating portions, which are arranged in the scanning direction at intervals different from the engagement/disengagement intervals, each regulating portion being capable of changing the posture of a corresponding engagement/disengagement body, in accordance with a stopping position of the carriage, from the first posture to the second posture.

15. An ink supply device as claimed in claim 14, further comprising:

a single power source; and a clutch for selectively transmitting drive power from the power source to drive all the engagement/disengagement bodies to simultaneously move vertically, each engagement/disengagement body being capable of changing its posture from the first posture to the second posture by the corresponding regulating portion while moving vertically.

16. An ink supply device as claimed in claim 15, wherein the clutch is switchable between an ON condition, wherein power is transmitted from the power source to all the engagement/disengagement bodies, and an OFF condition, wherein power is not transmitted from the power source to all the engagement/disengagement bodies, the clutch being switched between its ON and OFF conditions according to movement of the carriage toward and away from the ink supply region.

17. An ink supply device as claimed in claim 16, further comprising clutch maintaining means for locking the clutch in the ON condition after the carriage reaches a predetermined position in the ink supply region, and for unlocking the clutch from the ON condition to the OFF condition when the carriage moves away from the predetermine position in the ink supply region a predetermined distance or greater.

18. An ink supply device as claimed in claim 17, further comprising lock release means capable of returning the clutch maintaining means to release the clutch from the ON condition to the OFF condition in association with movement of the carriage toward the Ink supply region.

19. An ink supply device as claimed in claim 18, wherein the clutch maintaining means includes:

a toggle bar for pivoting between its locked condition and its lock release condition; and an urging spring for maintaining the toggle bar in each of the locked condition and the lock release condition.

20. An ink supply device as claimed in claim 19, further comprising:

a power transmission mechanism capable of transmitting power to the clutch;

a power driven mechanism for receiving power and for being driven by the power;

another power transmission mechanism for receiving power from the power source and for being capable of transmitting the power both to the power driven mechanism and to the power transmission mechanism.

21. An ink supply device as claimed in claim 20, wherein the power driven mechanism includes a sheet transport mechanism for transporting a recording sheet in a sheet transport direction orthogonal to the scanning direction.

22. An ink supply device as claimed in claim 21, wherein the carriage further includes a recording head portion capable of ejecting ink, the power driven mechanism including a maintenance operation mechanism for performing a maintenance operation onto the recording head portion.

23. An ink jet printer, comprising:

a carriage capable of being moved in a scanning direction within a scanning region, the scanning region including an ink supply region and a printing region, the carriage being provided with a plurality of hoppers for receiving ink of a plurality of different colors, respectively, the hoppers being arranged in the scanning direction, the carriage being further provided with a recording head portion capable of ejecting ink received in the plurality of hoppers;

a sheet transport mechanism for transporting a recording sheet in a sheet transport direction orthogonal to the scanning direction, the sheet transport mechanism transporting the sheet in the printing region along the scanning direction;

an ink storing unit, disposed in the ink supply region, for storing ink of the plurality of different colors, the ink storing unit including a plurality of ink supplying portions each for supplying ink of a corresponding color, the plurality of ink supplying portions being arranged in the scanning direction, distances between the ink supplying portions along the scanning direction being different from distances between the hoppers along the scanning direction; and a carriage scanning control mechanism for controlling the carriage to move in the scanning direction, the carriage scanning control mechanism selectively stopping the carriage at a plurality of predetermined different stopping positions relative to the ink storing unit, thereby selectively controlling the ink supplying portions to supply ink of the corresponding colors from the ink storing unit to the corresponding hoppers according to the plurality of predetermined different stopping positions of the carriage the plurality of predetermined different stopping positions being defined in correspondence with the plurality of different colors, wherein the carriage scanning control mechanism selectively stops the carriage at a desired stopping position thereby allowing a corresponding hopper to be aligned with a corresponding ink supply portion while preventing remaining hoppers from being aligned with the remaining ink supply portions and controls the corresponding ink supply portion to supply ink of the corresponding color to the aligned, corresponding hopper.

24. An ink supply device for use in an ink jet printer, the ink supply device comprising:

a carriage, capable of being scanned in a scanning direction, the carriage being provided with a plurality of hoppers for receiving a plurality of different colored inks, the hoppers being disposed on the carriage and aligned in the scanning direction separated by first distances in the scanning direction;

a carriage scanning mechanism for scanning the carriage in the scanning direction within a scanning region, the scanning region including an ink supply region;

an ink case, disposed at the ink supply region, for storing the plurality of different colored inks, the ink case being formed with a plurality of ink discharging portions capable of discharging the plurality of different colored inks stored in the ink case, the ink discharging portions being aligned in the scanning direction and separated from one another by second distances different from the first distances; and an ink discharge control mechanism for controlling the carriage scanning mechanism to selectively stop scanning movement of the carriage in the scanning direction and selectively discharging each color ink from a corresponding discharging portion to the corresponding hopper according to stopping position of the carriage in the scanning direction, wherein the ink discharge control mechanism controls the carriage scanning mechanism to selectively stop the carriage at a plurality of predetermined different stopping positions which are defined in correspondence with the plurality of different colored inks, respectively, the ink discharge control mechanism controlling the carriage scanning mechanism to selectively stop the carriage at one desired stopping position, thereby allowing, a corresponding hopper to confront the corresponding ink discharging portion while preventing remaining hoppers from confronting remaining ink discharging portions and discharging ink of a corresponding color from the corresponding ink discharging portion to the corresponding hopper, while preventing ink of remaining colors from being discharged from remaining ink discharging portions to the remaining hoppers.

25. An ink supply device as claimed in claim 24, further comprising a sheet transport mechanism for transporting the recording sheet in a sheet transport direction different from the scanning direction.

26. An ink supply device as claimed in claim 24, wherein the carriage is further mounted with a recording head portion for ejecting ink onto a surface of a recording sheet.

27. An ink supply device as claimed in claim 24, wherein the ink case is for storing ink pellets of different colored hot melt ink, the discharging portions being adapted for discharging the ink pellets from the ink case, the hoppers being each adapted for receiving a different colored ink pellet and being adapted for melting the ink pellets.

28. An ink supply device as claimed in claim 24, wherein the ink case is for storing liquid ink of different colors, the discharging portions being adapted for discharging the liquid ink from the ink case, the hoppers being each adapted for receiving a different colored ink.

29. An ink supply device as claimed in claim 28, wherein the discharging portions are provided at a position, below which the hoppers on the carriage can be moved, and wherein the ink discharge control mechanism includes:

a control mechanism for controlling the carriage scanning mechanism to adjust the stopping position of the carriage;

pressing bodies for pressing the ink pellets out of corresponding discharging portions and into corresponding hoppers;

engagement/disengagement bodies provided with a changeable posture, the engagement/disengagement bodies having a certain posture selectively operating corresponding pressing bodies when driven; and selectively regulating members provided to the carriage and selectively changing posture of the engagement/disengagement bodies in accordance with stopping position of the carriage.

30. An ink supply device as claimed in claim 29, further comprising a clutch capable of selectively transmitting drive power to drive all the engagement/disengagement bodies to simultaneously move vertically.

31. An ink supply device as claimed in claim 30, further comprising a power source, wherein the clutch is switchable between an ON condition, wherein power is transmitted from the power source to the engagement/disengagement bodies, and an OFF condition, wherein power is not transmitted from the power source to the engagement/disengagement bodies, the clutch being switched between its ON and OFF conditions according to movement of the carriage toward and away from the ink supply portion.

32. An ink supply device as claimed in claim 31, wherein the clutch is temporarily locked in the ON condition when the carriage moves toward the ink supply region, and the clutch is unlocked from the ON condition when the carriage moves away from the ink supply region a predetermined distance or greater.

33. An ink supply device as claimed in claim 24, further comprising:

a single drive source for providing rotational power;

a power driven unit capable of receiving power and operating upon reception of power; and a power transmission portion for dividing rotational power from the drive source and for selectively transmitting the rotational power to an upstream side of the clutch and to the power driven unit, wherein the clutch includes switching means for switching the clutch into an ON condition, wherein rotational power from the power source is transmitted to the engagement/disengagement portions, and an OFF condition, wherein rotational power from the power source is not transmitted to the engagement/disengagement portions, according to movement of the carriage toward and away from the ink supply region.

34. An ink supply device as claimed in claim 33, wherein the power driven unit includes a medium transport mechanism for transporting a recording medium in a medium transport direction different from the scanning direction.

35. An ink supply device as claimed in claim 33, wherein the carriage is further mounted with a recording head portion for ejecting ink onto a surface of a recording sheet, and wherein the power driven unit includes maintenance means for subjecting the recording head portion to a maintenance operation.

36. An ink supply device as claimed in claim 33, wherein the switching means includes a clutch locking means for temporarily locking the clutch in the ON condition when the carriage moves toward the ink supply region, and subsequently unlocking the clutch from the ON condition when the carriage moves away from the ink supply region a predetermined distance or greater.

37. An ink supply device as claimed in claim 36, further comprising lock release means that, when the clutch locking means is switched into a posture that maintains the clutch in the ON condition, returns the clutch locking means to a posture that releases the clutch from the ON condition in association with movement of the carriage toward the ink supply portion.

38. An ink supply device as claimed in claims 37, wherein the clutch locking means includes:

a toggle bar for pivoting between a locked condition and a lock release condition; and an urging spring for maintaining posture of the toggle bar.

39. An ink jet printer, comprising:

a sheet transport mechanism for transporting a recording sheet in a sheet transport direction;

a carriage, capable of being scanned in a scanning direction different from the sheet transport direction, the carriage being provided with a plurality of hoppers for receiving a plurality of different colored inks, the hoppers being disposed on the carriage and aligned in the scanning direction separated by first distances in the scanning direction, the carriage being further provided with a recording head portion for ejecting ink onto a surface of a recording sheet;

a carriage scanning mechanism for scanning the carriage in the scanning direction within a scanning region, the scanning region including an ink supply region;

an ink case, disposed at the ink supply region, for storing the plurality of different colored inks, the ink case being formed with a plurality of ink discharging portions capable of discharging the plurality of different colored inks stored in the ink case, the ink discharging portions being aligned in the scanning direction and separated from one another by second distances different from the first distances; and an ink discharge control mechanism for controlling the carriage scanning mechanism to selectively stop scanning movement of the carriage in the scanning direction and selectively discharging each color ink from a corresponding discharging portion to the corresponding hopper according to stopping position of the carriage in the scanning direction, wherein the ink discharge control mechanism controls the carriage scanning mechanism to selectively stop the carriage at a plurality of predetermined different stopping positions which are defined in correspondence with the plurality of colored inks, respectively, the ink discharge control mechanism controlling, the carriage scanning mechanism to selectively stop the carriage at one desired stopping position, thereby allowing a corresponding hopper to confront a corresponding ink discharging portion while preventing remaining hoppers from confronting remaining ink discharging portions, and discharging ink of a corresponding color from the corresponding ink discharging portion to the corresponding hoppers while preventing ink of remaining colors from being discharged from the remaining ink discharging portions to the remaining hoppers.

40. An ink jet printer according to claim 39, wherein the ink discharge control mechanism includes:

a scanning control mechanism for controlling the carriage scanning mechanism to selectively stop scanning movement of the carriage in the scanning direction; and a discharge control mechanism for selectively discharging each color ink from a corresponding discharging portion to the corresponding hopper according to stopping position of the carriage in the scanning direction.

41. An ink jet printer as claimed in claim 40, further comprising:

a clutch for selectively driving the discharge control mechanism;

a single drive source for providing rotational power;

a power driven unit capable of receiving power and operating upon reception of power; and a power transmission portion for dividing rotational power from the drive source and for selectively transmitting the rotational power to an upstream side of the clutch and to the power driven unit, wherein the clutch includes switching means for switching the clutch into an ON condition, wherein rotational power from the power source is transmitted to the discharge control mechanism, and an OFF condition, wherein rotational power from the power source is not transmitted to the discharge control mechanism, according to movement of the carriage toward and away from the ink supply region.

* * * * *